US006660689B2

(12) United States Patent
Serizawa et al.

(10) Patent No.: US 6,660,689 B2
(45) Date of Patent: Dec. 9, 2003

(54) RECORDING MATERIAL

(75) Inventors: Shinichiro Serizawa, Shizuoka-ken (JP); Yasuhiro Ogata, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 93 days.

(21) Appl. No.: 09/947,535

(22) Filed: Sep. 7, 2001

(65) Prior Publication Data

US 2002/0058589 A1 May 16, 2002

(30) Foreign Application Priority Data

Sep. 8, 2000 (JP) ..... 2000-273719
Sep. 13, 2000 (JP) ..... 2000-278056

(51) Int. Cl.[7] ..... B41M 5/40
(52) U.S. Cl. ..... 503/226; 503/200
(58) Field of Search ..... 503/200, 226

(56) References Cited

U.S. PATENT DOCUMENTS 4,727,054 A * 2/1988 Yuyama et al. ..... 503/200
5,236,883 A * 8/1993 Nakazawa et al. ..... 503/200
5,238,900 A * 8/1993 Shuku ..... 503/207

FOREIGN PATENT DOCUMENTS

JP 11-34495 2/1999

* cited by examiner

*Primary Examiner*—B. Hamilton Hess
(74) *Attorney, Agent, or Firm*—Sughrue Mion, PLLC

(57) ABSTRACT

A recording material having a resin layer which contains a high concentration of a water-soluble resin such as polyvinyl alcohol, and which has excellent gas blocking property and flatness. Image defects such as non-uniform color and the like do not arise at the recording material. The recording material has, on a support, a recording layer which can form color due to application of heat and/or pressure thereto. At least one resin layer is provided between the support and the recording layer. The resin layer is formed by coating a low viscosity coating solution, and easily forms a flat surface by leveling.

20 Claims, No Drawings

RECORDING MATERIAL

BACKGROUND OF THE INVENTION

1. Field of the Invention

The present invention relates to a recording material, and in particular, to a recording material which can be recorded by being heated or by pressure being applied thereto.

2. Description of the Related Art

Recording materials on which an image is recorded by heat being applied thereto by a thermal head or the like have come into wide use in recent years as the recording devices therefor are simple, reliable and do not require maintenance.

Such recording materials are formed to include, on a support, a recording layer which contains, as color forming components, for example, an electron donating dye precursor and an electron receiving compound, or a diazonium salt compound and a coupler. An image is recorded by utilizing a color forming reaction of the color forming components which proceeds due to the application of heat.

In such a heat-sensitive type recording method (heat-sensitive recording), an image is recorded due to the application of heat. Thus, the surface temperature of the recording material at the time of image recording is high (e.g., a maximum of about 200° C. or more when a thermal head is used).

In heat-sensitive recording, in a case in which, for example, heat is applied continuously at a high temperature, the moisture in the recording layer vaporizes and moves toward the support. Due to water vapor and gasses accumulating at portions of the boundary surface between the recording layer and the support, so-called blistering occurs, in which the support and the recording layer deform. The occurrence of such blistering and the like results in a deterioration in the quality of the image surface and in the quality of the material on which the image is recorded, such that defects arise at the image printed surface (hereinafter, "image printed surface defects").

As a means for preventing image printed surface defects such as blistering in which the support and the like deform due to the accumulation of water vapor or the like generated from the recording layer as described above, there is a method of interposing, at the boundary surface between the recording layer and the support, a layer having low permeability with respect to gas water vapor, e.g., a resin layer containing a binder such as polyvinyl alcohol or mica or the like. However, if the formed resin layer is not uniform and flat, the flatness of the surface of the recording layer which is formed on the resin layer is poor, which leads to a deterioration in image quality, such as non-uniform color, and the quality of the recording material deteriorates.

Accordingly, in order for the resin layer to be formed uniform and flat, the viscosity of a coating solution for resin layer formation must be a low viscosity which allows the coating solution, after being coated, to level so as to form a flat surface. "Leveling" means that the unevenness of the coated film surface formed by the coating solution being applied, i.e., film thickness differences of the coated film, becomes uniform and flat due to the weight thereof, during the period of time from coating to drying.

From the standpoints of convenience of handling and the like, a water soluble resin such as polyvinyl alcohol (PVA) or the like is used in a binder. Conventionally, PVA coating solutions were usually prepared by using water as the solvent. However, when water alone is used as the solvent, it is not possible to obtain a coating solution of a low viscosity to an extent at which the above-described leveling can be expected. Further, in this process, it is difficult to appropriately control the viscosity of the coating solution, and application by, for example, a gravure coating method or the like, is difficult. Moreover, when the viscosity of the coating solution is high, a long time is required for drying, such that the burden of the drying process is large. On the other hand, if the coating solution is diluted to a viscosity which permits leveling and easy formation of a good film surface, the concentration of the binder component in the coating solution becomes too low, and a problem arises in that, even if the solution is coated, the desired resin layer cannot be obtained. Namely, it is difficult to easily form a resin layer which has a desired film thickness and in which a sufficient reduction in gas permeability is possible.

As described above, a coating solution for formation of a resin layer, which contains a high concentration of a water soluble resin such as PVA and which has a low viscosity to an extent that leveling can be expected, has not yet been developed. Accordingly, it is currently the state that a recording material which has between the recording layer and the support a resin layer which is uniform, has a flat surface, and has excellent gas blocking ability has not yet been obtained.

SUMMARY OF THE INVENTION

The present invention overcomes the above-described drawbacks of the conventional art, and achieves the following object. Namely, an object of the present invention is to provide a recording material in which image defects such as non-uniform color do not arise, and which has a resin layer which has an excellent gas blocking ability and is flat, and which is formed by a coating solution having a high concentration of a water soluble resin such as PVA and a low viscosity which enables formation of a flat surface due to leveling.

A recording material of the present invention has a support; a recording layer which can form color due to application of heat and/or pressure thereto; and, between the support and the recording layer, at least one layer (resin layer) containing polyvinyl alcohol. It is preferable that the degree of saponification of the polyvinyl alcohol is 30 mol % to 90 mol %, and that the degree of polymerization of the polyvinyl alcohol is 1000 or less.

Further, a recording material of the present invention has a support; a recording layer which can form color due to application of heat and/or pressure thereto; and, between the support and the recording layer, a resin layer formed by coating a coating solution which is prepared by dissolving polyvinyl alcohol in a mixed solvent whose ratio (mass ratio) of a contained amount of alcohol with respect to water is 1 or less.

Moreover, a recording material of the present invention has a support; a layer (resin layer) containing polyvinyl alcohol and provided on the support; and a recording layer provided on the resin layer, wherein the resin layer is a resin layer formed by processes of dissolving polyvinyl alcohol in a mixed solvent of water and alcohol, adding methanol to an obtained solution to adjust a viscosity to a desired viscosity, coating an obtained coating solution on the support, and drying a coated layer. The viscosity at 40° C. of the coating solution is preferably 5 to 100 mPa·s.

DESCRIPTION OF THE PREFERRED EMBODIMENTS

The recording material of the present invention is formed by forming, by coating, a resin layer by using a coating solution which has polyvinyl alcohol as a binder component and which is prepared by dissolving the polyvinyl alcohol in a mixed solvent of alcohol and water.

Hereinafter, the recording material of the present invention will be described in detail.

Note that, in the present application, numerical ranges are to be interpreted as encompassing both the minimum value and the maximum value stated for the range.

<<Recording Material>>

The recording material of the present invention includes, on a support, a recording layer which can form color due to application of heat and/or pressure, and at least one layer (hereinafter, "resin layer") containing polyvinyl alcohol, and, if needed, other layers such as a protective layer or the like.

[Resin Layer]

The resin layer contains, as a binder and as the main component thereof, polyvinyl alcohol (hereinafter, "PVA"), and preferably contains a water swellable synthetic mica. If necessary, the resin layer may contain other components such as gelatin, a hardening agent, a surfactant, a water soluble resin other than PVA, and the like.

The resin layer is one or more layers provided between the support and the recording layer. Preferably, at least one resin layer is provided as an undercoat layer which is the first layer provided on the surface of the support.

By providing the resin layer between the support and the recording layer, at the time when heat is applied during recording, it is possible to effectively prevent printed image surface defects due to, for example, the occurrence of blistering, which is the deformation of the recording material on which an image is recorded due to water vapor or the like from the recording layer remaining at the boundary surface of the recording layer and the support. Further, the resin layer is not limited to the above, and may be formed, for example, between two recording layers.

The resin layer can be formed by applying on the support, by a known coating method, a coating solution for resin layer formation (which hereinafter is referred to upon occasion as "coating solution for resin layer" or simply "coating solution"). In the present invention, a coating solution for resin layer prepared as follows is coated.

(Coating Solution for Resin Layer)

The coating solution for resin layer relating to the present invention is prepared by dissolving PVA in a mixed solvent of water and alcohol. The coating solution includes PVA as the main component, and preferably includes a water swellable synthetic mica. The coating solution may contain other components as needed.

Solvent

A mixed solvent of alcohol and water is used as the solvent in which the PVA is dissolved. In this way, the viscosity of the solution after the PVA has been dissolved can be kept low, and a coating solution for resin layer having a low viscosity can ultimately be prepared. The viscosity of the coating solution is preferably a viscosity which does not result in a deterioration in the surface properties of the recording layer formed on the resin layer, and which allows the coating surface, after coating and before drying, to level smoothly such that a smooth, flat surface can be formed. "Leveling" is as was defined previously.

In the present invention, it is preferable that the ratio (mass ratio) of the content of alcohol to water is 1 or less. When this content ratio (mass ratio) exceeds 1, i.e., when the amount of alcohol contained in the mixed solvent exceeds 50% by mass, the viscosity of the coating solution may again rise and the stability of the coating solution may deteriorate. On the other hand, when the contained amount of alcohol is near zero, i.e., when the amount of alcohol contained in the mixed solvent is less than about 10% by mass, the viscosity cannot be made to be sufficiently low, and it may not be possible to obtain a surface state having excellent flatness due to the leveling effect.

Further, from the standpoint of the viscosity of the coating solution being stable and good, the content ratio (mass ratio) of the alcohol in the entire solvent contained in the coating solution for resin layer is preferably 0.10 to 0.85, and more preferably 0.25 to 0.80.

The alcohol may be selected appropriately from among known alcohols, and examples include methanol, ethanol, isopropyl alcohol (IPA), butyl alcohol, and the like. Among these, methanol is preferable from the standpoints of solubility of the PVA and dryability after coating.

Generally, after partially-saponified PVA, which is a water soluble resin, is completely dissolved in water, the final coating solution for resin layer can be formed by adding an alcohol such as methanol or the like thereto. However, when a mixed solvent of water and alcohol is used as a solvent in which partially-saponified PVA is to be dissolved, the ratio of the amount of methanol contained in the coating solution for resin layer which is finally prepared can be improved, and a coating solution having a lower viscosity can be obtained. Namely, in a case in which water is used as a solvent, the range over which the viscosity of the coating solution can be controlled is narrow, and adjustment of the viscosity in accordance with the object is difficult. However, with a mixed solvent of water and methanol, viscosity control which is more suitable for lowering the viscosity can be carried out easily.

The viscosity (40° C.) of the coating solution for resin layer is preferably 5 to 100 mPa·s, and more preferably 15 to 50 mPa·s. When the viscosity is less than 5 mPa·s, it is easy for the coating solution to be affected by drying air immediately after drying, and it may not be possible to obtain a leveled, flat coated surface. When the viscosity exceeds 100 mPa·s, control of the film thickness of the coated film may be difficult.

The viscosity can easily be measured by a B-type viscometer, an E-type viscometer, or the like.

The temperature at the time of dissolving the PVA in the mixed solvent is preferably 20 to 50° C. When the temperature is less than 20° C., the viscosity may increase such that leveling deteriorates and the coated surface state deteriorates. When the temperature exceeds 50° C., there may be much transpiration of the alcohol in the mixed solvent such that the concentration rises and the viscosity of the coated solution rises.

Enabling a decrease in the viscosity of the coating solution for the resin layer means enabling the amount of PVA dissolved in a given amount of solvent to increase. In other words, the dissolved concentration of PVA in the coating solution for resin layer can be improved while a viscosity which is good for coating is maintained. Because the contained amount of PVA forming the resin layer formed by coating increases, the ability to block gasses such as oxygen in the air and the like improves. As a result, it is possible to effectively prevent printed image surface defects such as blistering, in which deformation is caused due to water vapor or the like from the recording layer remaining at the boundary surface of the recording layer and the support.

Further, an improvement in the proportion of the alcohol solvent in the coating solution contributes as well to an improvement in the dryability of the coated film after coating. Accordingly, the drying process can be greatly reduced.

The method for preparing the coating solution for resin layer relating to the present invention is not particularly limited. For example, the coating solution can be prepared by the method described hereinafter.

First, polyvinyl alcohol (PVA) is dissolved in a mixed solution of water and alcohol (so as to form a PVA solution, which is solution I). As described above, by dissolving PVA in this mixed solution, a PVA solution having an extremely low viscosity can be prepared.

Second, a desired amount of methanol (solution II) is added to above solution I. By adding solution II, the viscosity of the coating solution for resin layer can be lowered or controlled. As described above, by using a mixed solution containing methanol in solution I, the ratio of methanol contained in the coating solution can be increased. Namely, a coating solution having a lower viscosity can be prepared, and flattening by leveling can thereby easily be achieved. Moreover, control of the viscosity at the time of application is easy.

Third, in a case in which synthetic mica is contained, synthetic mica, or a water swellable synthetic mica dispersion solution (solution III), in which synthetic mica is dispersed at high speed in water by a homogenizer or the like, is readied. It is possible to directly add synthetic mica to solution I. However, when synthetic mica is added, the viscosity increases, and it may not be possible to obtain a low viscosity coating solution, or dispersion may be insufficient. As a result, it is preferable to prepare solution III in advance, and to add solution III to solution I. By adding solution III to solution I simultaneously with the addition of solution II, or by adding solution III to solution I after the addition of solution II, the coating solution for a resin layer relating to the present invention can finally be prepared.

Polyvinyl Alcohol (PVA)

The degree of saponification of the PVA relating to the present invention is preferably 30 mol % to 90 mol %, and more preferably 50 mol % to 90 mol %.

When the degree of saponification is less than 30 mol %, the solubility in water is poor, and it may not be possible to prepare a stable coating solution. Moreover, the resin layer which is formed at this time has a low content of PVA and has a poor gas blocking ability, and thus the generation of blistering cannot be effectively suppressed. When the degree of saponification exceeds 90 mol %, the solubility in alcohol, and methanol in particular, is poor, and it may not be possible to prepare a stable coating solution. For example, if the PVA is completely saponified (a degree of saponification of 98 mol % or more), dissolving in methanol is poor, and thus it is easy for unevenness to arise at the surface of the coated layer.

The degree of polymerization of the PVA is preferably 1000 or less, more preferably 800 or less, and particularly preferably 500 or less. When the degree of polymerization of the PVA exceeds 1000, the viscosity rises, and moisture control of the coating solution is difficult. It may be the case that leveling does not occur such that a flat resin layer cannot be formed. Moreover, a degree of polymerization of 100 or more is preferable, and 300 or more is more preferable. If the degree of polymerization is less than 100, the adherability of the resin layer is poor. Here, the degree of polymerization of the PVA is the viscosity average degree of polymerization, which is determined from the viscosity of an acetone solution of polyvinyl acetate obtained by re-acetylation of the PVA.

A PVA having a degree of saponification of 30 to 90 mol % and a degree of polymerization of 1000 or less has excellent compatibility with respect to mixed solvents of water and alcohols, and a stable coating solution can be prepared by use thereof. Thus, such a PVA is particularly preferable as the PVA used in the coating solution for resin layer relating to the present invention.

The amount of PVA contained in the coating solution for resin layer is preferably 2 to 20% by mass and more preferably 5 to 10% by mass of the total mass.

When the contained amount is less than 2% by mass, the viscosity becomes too low, and a greater amount of coating solution is required in order to apply the requisite amounts of PVA and mica. As a result, it may be the case that the dryability is poor, non-uniformity of the coated surface state arises, the gas blocking ability is poor, and printed image surface defects such as blistering cannot be effectively prevented. If the contained amount exceeds 20% by mass, the viscosity of the coating solution is high, and the coated solution surface state may be non-uniform.

The coated amount of PVA is, per 1 $m^2$, preferably 0.5 g or more, and more preferably 0.8 g or more. If the coated amount is less than 0.5 g per 1 $m^2$, a sufficient gas permeation suppressing effect cannot be exhibited. The upper limit of the coated amount is, per 1 $m^2$, preferably 2.0 g or less, and more preferably 1.5 g or less. If the coated amount exceeds 2.0 g per 1 $m^2$, the heat absorbability increases and the heat applied from the thermal head is absorbed. Thus, sensitivity and $D_{max}$, and the $D_{max}$ of cyan in particular, of the recording material are lowered.

The film thickness of the resin layer formed by the coating solution is preferably 0.5 $\mu$m to 2.5 $\mu$m, and more preferably 0.5 $\mu$m to 2.0 $\mu$m. If the film thickness is less than 0.5 $\mu$m, the gas permeation suppressing effect is insufficient. If the film thickness exceeds 2.5 $\mu$m, it is easy for the heat from the thermal head to be absorbed, and $D_{max}$ decreases and the uniformity of the coated film deteriorates, thus leading to a deterioration in image quality.

The polyvinyl alcohol (PVA) which can be used in the present invention is a known polyvinyl alcohol whose degree of saponification and degree of polymerization fall within the above-described ranges. A polyvinyl alcohol having good compatibility with respect to a methanol solvent or a mixed solvent of water and methanol is preferable. Examples of commercially available products are SMR-8L, SMR-10L, SMR-10M, SMR-10H, 20H, SMR-30H and the like manufactured by Shin-Etsu Chemical Co., Ltd.; PVA-203, PVA-205, PVA-403, PVA-405, L-8, L-9, PVA-505, KL-504, KL-506, C-506, LM-20 and the like manufactured by Kuraray Co., Ltd.; and GOSENOL KP-06, GOSENOL KP-08, GOSENOL NK-05, GOSENOL KL-05, GOSEFIMER K, GOSELAN L, and the like manufactured by The Nippon Synthetic Chemical Industry Co., Ltd.

A cationic polyvinyl alcohol containing a cationic group in the PVA is preferable as the PVA relating to the present invention. The method disclosed in Japanese Patent Application Publication (JP-B) No. 62-34242 can be used as the method for preparing a cationic PVA. Specifically, a method can be used in which a methanol solution of sodium hydroxide is added to a polyvinylacetate which is obtained by copolymerizing, by a known polymerization method, such as bulk polymerization, solution polymerization, suspension polymerization, emulsion polymerization, or the like, vinyl acetate and a monomer containing a quaternary ammonium salt such as (meth)acrylamide-propyl-trimethylammoniumchloride, such that saponification is carried out, and then drying is carried out. Or a method can be used in which, after vinyl acetate and a monomer containing an amino group such as dimethylaminoethyl(meth) acrylamide are copolymerized, a known quaternizing agent such as methyl chloride is added such that the amino group is quaternized, and thereafter drying is carried out.

Further, the content of the cationic group in the molecule of the cationic PVA is, in structural units, 0.01 to 20 mol %, and preferably 0.03 to 10 mol %, and more preferably 0.05 to 5 mol %. If the content of the cationic groups in the molecule is less than 0.01 mol % in structural units, the effect of cationizing the molecule is poor. On the other hand, even if the content of the cationic groups in the molecule exceeds 20 mol % in structural units, no further difference in properties is exhibited, and the production cost increases.

For example, a PVA in which a vinyl ester and the monomer expressed by following general formula (1) are copolymerized is preferably used as the cationic PVA. The production method disclosed in JP-B No. 62-34242 can be used as the method for producing this copolymer. However, the present invention is not limited to the same.

General Formula (1)

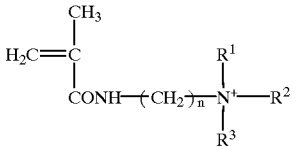

In general formula (1), $R^1$, $R^2$ and $R^3$ each independently represents a lower alkyl group. $R^1$, $R^2$ and $R^3$ may be substituted. Further, n represents an integer from 2 to 6.

Examples of the vinyl ester are vinyl acetate, vinyl propionate, vinyl formate, and the like. Vinyl acetate is particularly preferable.

In general formula (1), $R^1$, $R^2$ and $R^3$ each independently represents a lower alkyl group having from 1 to 6 carbon atoms. A methyl group, ethyl group, or propyl group is preferable, and a methyl group is particularly preferable. Further, $R^1$, $R^2$ and $R^3$ may be substituted. Examples of lower alkyl groups which have a substituent are a methylol group, aminoalkyl group, and the like.

In general formula (1), n represents an integer from 2 to 6 and, preferably, n=3.

Examples of commercially available cationic PVA are C-118, C-506, and C-318 (manufactured by Kuraray Co., Ltd.), and GOSEFIMER C-670, GOSEFIMER C-820, GOSEFIMER K-200, and GOSEFIMER K-210 (manufactured by The Nippon Synthetic Chemical Industry Co., Ltd.). Among these, C-506, GOSEFIMER C-670, and GOSEFIMER K-210 are preferable.

Water Swellable Synthetic Mica

The resin layer relating to the present invention preferably contains a laminar inorganic compound. The laminar inorganic compound is preferably a swellable inorganic laminar compound. Examples of such compounds include swellable clay minerals such as bentonite, hectorite, saponite, bidelite, nontronite, stevensite, beidellite, montmorillonite, and the like, swellable synthetic mica, swellable synthetic smectite, and the like. These swellable inorganic laminar compounds have a laminated structure formed from a unit crystal lattice layer of a thickness of 10 to 15 Angstroms, and metal atom replacement in the lattice is markedly greater than other clay minerals. As a result, a shortage of positive charges arises in the lattice layer, and in order to compensate therefor, cations such as $Na^+$, $Ca^{2+}$, $Mg^{2+}$ and the like are adsorbed between the layers. The cations existing between the layers are called exchangeable cations, and can be exchanged with various cations. In particular, in a case in which the cations between the layers are $Li^+$, $Na^+$ or the like, because the ion diameter is small, the bond between the laminar crystal lattices is weak, and swells greatly due to water. In this state, when shearing is applied, the bond cleaves easily, and a sol which is stable in water is formed. This trend is strong in bentonite and swellable synthetic mica, and thus, bentonite and swellable synthetic mica are preferable for the objects of the present invention. In particular, water swellable synthetic mica is preferable.

Examples of water swellable synthetic mica include Na tetrasic mica $NaMg_{2.5}(Si_4O_{10})F_2Na$, Li taeniolite(NaLi) $Mg_2(Si_4O_{10})F_2Na$, Li hectorite(NaLi)/$3Mg_2/3Li_{1/3}(Si_4O_{10})F_2$, and the like.

As for the size of the water swellable synthetic mica, the thickness is preferably 1 to 50 nm, and the surface size is preferably 1 to 20 $\mu$m. From the standpoint of control of diffusion, a smaller thickness is preferable. The plane face size is preferably greater, within a range which does not result in a deterioration in the flatness and transparency of the coated surface.

Accordingly, the aspect ratio of the water swellable synthetic mica is preferably 100 or more, and more preferably 200 or more, and most preferably 500 or more.

Mass Ratio of PVA and Water Swellable Synthetic Mica

The mass ratio (x/y) of the PVA (x) contained in the resin layer and the water swellable synthetic mica (y) is preferably in a range of 1.5 to 20, and more preferably in a range of 2 to 15, and particularly preferably in a range of 2 to 10. If the mass ratio exceeds 20, the gas permeability suppressing effect of the resin layer deteriorates. If the mass ratio is less than 1.5, the strength of the coated film deteriorates.

The water swellable synthetic mica is preferably used in the state of a dispersion liquid in which the mica is dispersed in a water based solvent. Preparation may be carried out by, for example, adding synthetic mica to water, and dispersing at high speed by a known emulsion disperser such as a homogenizer or the like, and adding a water soluble resin-containing aqueous solution such as gelatin or the like.

Usually, in a case in which gelatin is used, when the ratio of the mica increases (i.e., the ratio of mica to gelatin is 1.5 to 10% or more), the viscosity increases and gelling is promoted at a given concentration of solids (e.g., 5% to 10%). Here, examples of methods of lowering the viscosity are a method of lowering the concentration, a method of adding urea or salt or the like to the coating solution, and the like.

The contained amount of the water swellable synthetic mica is preferably 1/20 to 1/2 as expressed in a mica/gelatin mass ratio. When the contained amount is less than 1/20, the resin layer may not function sufficiently as an oxygen blocking layer. When the contained amount exceeds 1/2, the suitability for production, such as the coatability and the like, may deteriorate.

The coated amount of the water swellable synthetic mica at the resin layer is preferably 0.1 g/m$^2$ or more, and more preferably 0.2 g/m$^2$ or more. If the coated amount is less than 0.1 g/m$^2$, the oxygen blocking ability of the resin layer may deteriorate. The coated amount of the water swellable synthetic mica is preferably derived from the aforementioned coated amount of the PVA and aforementioned mass ratio of the PVA.

Hardening Agent

At the time when the recording layer is coated and formed on the resin layer, it is preferable that a hardening agent be contained for the purpose of preventing the resin layer from swelling due to the moisture contained in the coating solution for recording layer formation.

Examples of the hardening agent include dialdehydes such as glutalaldehyde, 2,3-dihydroxy-1,4-dioxane, and the like; boric acid; and the like.

The added amount of the hardening agent is in a range of 0.2 to 3.0% by mass of the total solids of the resin layer, and may be selected in accordance with a desired degree of hardness.

As described above, a low viscosity PVA dissolved solution is obtained by dissolving a polyvinyl alcohol, whose degree of saponification and degree of polymerization fall within the aforementioned ranges, in a mixed solvent of water and alcohol. A coating solution having a high content of alcohol and a low viscosity (the coating solution for the resin layer) can finally be prepared. By coating and forming the resin layer by using this coating solution, a resin layer having a leveled, flat surface can be formed stably. Accordingly, in a case in which a recording layer is formed on this layer, the flatness of the surface of the recording layer is not adversely affected (there are no printed image surface defects), and an image without image defects such as non-uniform color can be formed. Further, because the content of alcohol is high, the burden of drying ability can be reduced, and the effect of reducing the gas permeability by an increase in the concentration of PVA can be improved. Moreover, it is easy to control the viscosity in the processes.

Next, other layers, such as the recording layer, the protective layer and the like, which form the recording material of the present invention, will be described.

[Recording Layer]

The recording layer is a layer which can form color due to the application of heat and/or pressure thereto, and has at least a color forming component. The recording layer may be a single-color recording layer which is a single layer, or may be a multi-color recording layer formed by layering a plurality of single-color recording layers which form colors of respectively different hues. The recording layer may contain other components as needed, such as basic substances, sensitizers, or the like.

In a case in which the recording layer is a plurality of layers, resin layers formed by the above-described coating solution for resin layer may be formed as intermediate layers between the respective recording layers.

Further, in the case of a recording material for multi-color image formation, the recording material may have two or more recording layers which can form colors of respectively different hues due to application of heat and/or pressure.

Generally, in a recording material for plural colors, in order to provide an uneven difference in the energies applied to the respective recording layers such that desired colors are formed, blistering is remarkable at the time of image printing at a high printing energy. However, in the recording material of the present invention, the generation of blisters is suppressed by the gas permeation suppression due to the resin layer of the present invention, and high image quality of multi-color images can be maintained.

The recording material for plural colors may be a recording material which can form a full color image due to recording layers which form colors of, for example, cyan, magenta, and yellow, being layered. The structural examples of recording materials for plural colors and the recording methods disclosed in Japanese Patent Application Laid-Open (JP-A) No. 11-34495, columns 36-38 may be applied to the recording material of the present invention.

(Color Forming Components and the Like)

The color forming components are preferably components which are colorless at normal temperature and normal pressure, and which form color due to the application of heat and/or pressure thereto. Suitable examples of such color forming sources are the following combinations of two components (a color forming component and a compound which is made to color) listed as following (i) through (xviii). (In each of the following examples, the first compound listed is the color forming component, and the second compound listed is the compound which is made to color.)

(i) a combination of an electron donating dye precursor and an electron receiving compound
(ii) a combination of a photo-decomposable diazonium salt compound and a coupling component (hereinafter referred to as "coupler" when appropriate)
(iii) a combination of an organic acid metal salt such as silver behenate, silver stearate or the like, and a reducing agent such as protocatechuic acid, spiroindane, hydroquinone or the like
(iv) a combination of a long-chain fatty acid iron salt such as iron (II) stearate, iron (II) myristinate or the like, and a phenol such as tannic acid, gallic acid, ammonium salicylate or the like
(v) a combination of an organic heavy metal salt such as a nickel, cobalt, lead, copper, iron, mercury, silver salt or the like of acetic acid, stearic acid, palmitic acid or the like, and an alkali metal or an alkali earth metal sulfide such as calcium sulfide, strontium sulfide, potassium sulfide or the like; or a combination of such an organic heavy metal salt and an organic chelating agent such as s-diphenylcarbazide, diphenylcarbazone or the like
(vi) a combination of a heavy metal sulfate such as a sulfate of silver, lead, mercury, sodium or the like, and a sulfur compound such as sodium tetrathionate, sodium thiosulfate, thiourea or the like
(vii) a combination of an aliphatic iron (II) salt such as iron (II) stearate or the like, and an aromatic polyhydroxy compound such as 3,4-hydroxytetraphenylmethane or the like
(viii) a combination of an organic metal salt such as oxalate, mercury oxalate or the like, and an organic polyhydroxy compound such as polyhydroxy alcohol, glycerin, glycol or the like
(ix) a combination of a fatty acid iron (II) salt such as iron (II) pelargonate, iron (II) laurate or the like, and a thiocetylcarbamide or isothiocetylcarbamide derivative
(x) a combination of an organic acid lead salt such as lead capronate, lead pelargonate, lead behenate or the like, and a thiourea derivative such as ethylene thiourea, N-dodecyl thiourea or the like
(xi) a combination of a higher aliphatic heavy metal salt such as iron (II) stearate, copper stearate or the like, and zinc dialkyldithiocarbamate
(xii) a combination which forms an oxazine dye such as a combination of resorcin and a nitroso compound
(xiii) a combination of a formazan compound and a reducing agent and/or a metal salt
(xiv) a combination of a protected dye (or leuco dye) precursor and a deprotecting agent
(xv) a combination of an oxidation type color forming agent and an oxidizing agent
(xvi) a combination of a phthalonitrile and a diiminoisoindoline (a combination by which phthalocyanine is generated)
(xvii) a combination of an isocyanate and a diiminoisoindoline (a combination by which a colored pigment is generated)
(xviii) a combination of a pigment precursor and an acid or a base (a combination by which a pigment is formed)

Among these, in the present invention, (i) a combination of an electron donating dye precursor and an electron receiving compound, (ii) a combination of a photo-decomposable diazonium salt compound and a coupler, and (iii) a combination of an organic metal salt and a reducing agent are preferable, and thereamong, combinations (i) and (ii) are preferable, and combination (ii) is most preferable.

The same holds for a case in which the present invention is applied to a full color recording material as well.

Any of various structures can be used for the recording layer of the recording material of the present invention. However, it is preferable that the recording material includes, on a support, at least one light fixing type recording layer whose main components are a diazonium salt compound and a coupler which engages in a coupling reaction with the diazonium salt compound. In the case of a multicolor recording material, it is preferable that the recording material has recording layers formed by cyan, yellow, and magenta, as well as diazo color forming components. Further, as needed, a protective layer may be provided as the outermost layer on the recording layer at the surface side thereof where illuminated light is incident. As mentioned above, a structure in which intermediate layers are provided between the respective recording layers of a multi-layer structure is also suitable. A specific structural example will be described hereinafter.

Examples of other compounds used in the recording layer containing the diazonium salt compound and the coupler are sensitizers, basic substances which promote the reaction between the diazonium salt compound and the coupler, and the like.

Electron Donating Dye Precursor

Examples of the electron donating dye precursor used in above combination (i) are compounds such as phthalide compounds, fluoran compounds, phenothiazine compounds, indolylphthalide compounds, leucoauramine compounds, rhodamine lactam compounds, triphenylmethane compounds, triazene compounds, spiropyran compounds, pyridine compounds, pyrazine compounds, fluorene compounds, and the like.

Examples of phthalide compounds are the compounds disclosed in U.S. Reissue Pat. No. 23,024 and U.S. Pat Nos. 3,491,111, 3,491,112, 3,491,116, and 3,509,174. Specific examples include 3,3-bis(p-dimethylaminophenyl)-6-dimethylaminophthalide, 3,3-bis(p-dimethylaminophenyl) phthalide, 3-(p-dimethylaminophenyl)-3-(1,3-dimethylmdol-3-yl)phthalide, 3-(p-dimethylaminophenyl)-3-(2-methylindol-3-yl)phthalide, and the like.

Examples of fluoran compounds are the compounds disclosed in U.S. Pat. Nos. 3,624,107, 3,627,787, 3,641,011, 3,462,828, 3,681,390, 3,920,510, and 3,959,571. Specific examples include 2-(dibenzylamino)fluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chloro-6-diethylaminofluoran, 2-anilino-3-methyl-6-N-ethyl-N-isobutylaminofluoran, 2-anilino-6-dibutylaminofluoran, 2-anilino-3-methyl-6-N-methyl-N-tetrahydrofurfurylaminofluoran, 2-anilino-3-methyl-6-piperidinoaminofluoran, 2-(o-chloroanilino)-6-diethylaminofluoran, 2-(3,4,-dichloroanilino)-6-diethylaminofluoran, and the like.

Examples of phenothiazine compounds include benzoyl leucomethylene blue, p-nitrobenzyl leucomethylene blue, and the like.

Examples of leucoauramine compounds include 4,4'-bis-dimethylaminobenzohydrinebenzylether, N-halophenyl-leucoauramine, N-2,4,5-trichlorophenylleucoauramine, and the like.

Examples of the rhodamine lactam compound include rhodamine-B-anilinolactam, rhodamine-(p-nitroanilino) lactam, and the like.

Examples of the spiropyran compounds include the compounds disclosed in U.S. Pat. No. 3,971,808. Specific examples include 3-methyl-spiro-dinaphthopyrane, 3-ethyl-spiro-dinaphthopyrane 3,3'-dichloro-spiro-dinaphthopyrane, 3-benzylspiro-dinaphthopyrane, 3-methyl-naphtho-(3-methoxy-benzo)spiropyran, 3-propyl-spiro-dibenzopyrane, and the like.

Examples of the pyridine and pyrazine compounds are the compounds disclosed in U.S. Pat. Nos. 3,775,424, 3,853,869, and 4,246,318.

Examples of fluorene compounds are the compounds disclosed in Japanese Patent Application No. 61-240989.

The dye precursors disclosed in U.S. Pat. No. 4,800,149 can be used as the dye precursors which form cyan, magenta, and yellow. Further, the dye precursors disclosed in U.S. Pat. No. 4,800,148 can be used as the electron donating dye precursor for the yellow color forming dye. The dye precursors disclosed in JP-A No. 63-53542 can be used as the electron donating dye precursor for the cyan color forming dye.

Electron Receiving Compound

Examples of the electron receiving compound used in combination (i) are conventionally known electron receiving compounds such as phenol derivatives, salicylic acid derivatives, metal salts of aromatic carboxylic acid, acid clay, bentonite, novolak resin, metal treated novolak resin, metal complexes, and the like. Specific examples are disclosed in JP-B Nos. 40-9309 and 45-14039, and JP-A Nos. 52-140483, 48-51510, 57-210886, 58-87089, 59-11286, 60-176795, 61-95988, and the like.

Examples of phenol derivatives include 2,2'-bis(4-hydroxyphenyl)propane, 4-t-butylphenol, 4-phenylphenol, 4-hydroxydiphenoxide, 1,1'-bis(3-chloro-4-hydroxyphenyl) cyclohexane, 1,1'-bis(4-hydroxyphenyl)cyclohexane, 1,1'-bis(3-chloro-4-hydroxyphenyl)-2-ethylbutane, 4,4'-sec-isooctylidenediphenol, 4,4'-sec-butylidenediphenol, 4-tert-octylphenol, 4-p-methylphenylphenol, 4,4'-methylcychohexylidenephenol, 4,4'-isopentylidenephenol, benzyl p-hydroxybenzoate, and the like.

Examples of salicylic acid derivatives include 4-pentadecylsalicylate, 3,5-di(α-methylbenzyl)salicylate, 3,5-di(tert-octyl)salicylate, 5-octadecylsalicylate, 5-α-(p-α-methylbenzylphenyl)ethylsalicylate, 3-α-methylbenzyl-5-tert-octylsalicylate, 5-tetradecylsalicylate, 4-hexyloxysalicylate, 4-cyclohexyloxysalicylate, 4-decyloxysalicylate, 4-dodecyloxysalicylate, 4-pentadecyloxysalicylate, 4-octadecyloxysalicylate, and the like, and zinc, aluminum, calcium, copper, and lead salts, and the like thereof.

When combination (i) (electron donating dye precursor and electron receiving compound) is used as the color forming component, the contained amount of the electron donating dye precursor in the recording layer is preferably 0.1 to 5 g/m$^2$, and more preferably 0.1 to 1 g/m$^2$.

The contained amount of the electron receiving compound is preferably 0.5 to 20 parts by mass, and more preferably 3 to 10 parts by mass, with respect to 1 part by mass of the electron donating colorless dye. When the contained amount is less than 0.5 parts by mass, sufficient formed color density cannot be obtained, and when the contained amount exceeds 20 parts by mass, the sensitivity may decrease and the suitability for coating may deteriorate.

Diazonium Salt Compound

Compounds expressed by the following formula are preferable as the diazonium salt compound used in above combination (ii):

$$Ar—N_2^+ \cdot Y^-$$

wherein Ar represents an aromatic ring group, and $Y^-$ represents an acid anion.

In the above formula, Ar represents a substituted or unsubstituted aryl group. Examples of the substituent include an alkyl group, alkoxy group, alkylthio group, aryl group, aryloxy group, arylthio group, acyl group, alkoxycarbonyl group, carbamoyl group, carboamide group, sulfonyl group, sulfamoyl group, sulfonamide group, ureido group, halogen group, amino group, heterocyclic group, and the like. These substituents may be substituted.

As the aryl group, aryl groups having from 6 to 30 carbon atoms are preferable, and examples thereof include a phenyl group, 2-methylphenyl group, 2-chlorophenyl group, 2-methoxyphenyl group, 2-butoxyphenyl group, 2-(2-ethylhexyloxy)phenyl group, 2-octyloxyphenyl group, 3-(2,4-di-t-pentylphenoxyethoxy)phenyl group, 4-chlorophenyl group, 2,5-dichlorophenyl group, 2,4,6-trimethylphenyl group, 3-chlorophenyl group, 3-methylphenyl group, 3-methoxyphenyl group, 3-butoxyphenyl group, 3-cyanophenyl group, 3-(2-ethylhexyloxy)phenyl group, 3,4-dichlorophenyl group, 3,5-dichlorophenyl group, 3,4-dimethoxyphenyl group, 3-(dibutylaminocarbonylmethoxy) phenyl group, 4-cyanophenyl group, 4-methylphenyl group, 4-methoxyphenyl group, 4-butoxyphenyl group, 4-(2-ethylhexyloxy)phenyl group, 4-benzylphenyl group, 4-aminosulfonylphenyl group, 4-N,N-dibutylaminosulfonylphenyl group, 4-ethoxycarbonylphenyl group, 4-(2-ethylhexylcarbonyl) phenyl group, 4-fluorophenyl group, 3-acetylphenyl group, 2-acetylaminophenyl group, 4-(4-chlorophenylthio)phenyl group, 4-(4-methylphenyl)thio-2,5-butoxyphenyl group, 4-(N-benzyl-N-methylamino)-2-dodecyloxycarbonylphenyl group, and the like.

These groups may be substituted by an alkyloxy group, alkylthio group, substituted phenyl group, cyano group, substituted amino group, halogen atom, heterocyclic group, or the like.

Specific examples of the diazonium salt compound which can suitably be used as a color forming component are the diazonium salt compounds disclosed in JP-A No. 7-276808, paragraphs 44 through 49.

The wavelength $\lambda_{max}$ of maximum absorption of the diazonium salt compound is preferably 450 nm or less, and is more preferably 290 to 440 nm. Further, it is preferable that the number of carbon atoms of the diazonium salt compound is 12 or more, the solubility in water is 1% or less, and the solubility in ethyl acetate is 5% or more.

In the present invention, a single diazonium salt compound may be used, or two or more diazonium salt compounds can be used in accordance with an object such as adjustment of the hue or the like.

Coupler

The coupler used in above combination (ii) is a coupler which couples with a diazonium salt compound, which is used in combination in a basic atmosphere and/or a neutral atmosphere, so as to form a dye. Plural types of couplers may be used together in accordance with various objects such as adjustment of the hue or the like.

Couplers such as so-called active methylene compounds having a methylene group next to a carbonyl group, phenol derivatives, naphthol derivatives, and the like are preferably used as the coupler. Specific examples include resorcin, phloroglucin, 2,3-dihydroxynaphthalene, sodium 2,3-dihydroxynaphthalene-6-sulfonate, 1-hydroxy-2-naphthoic acid morpholinopropylamide, sodium 2-hydroxy-3-naphthalene sulfonate, 2-hydroxy-3-naphthalenesulfonic acid anilide, 2-hydroxy-3-naphthalenesulfonic acid morpholinopropylamide, 2-hydroxy-3-naphthalenesulfonic acid-2-ethylhexyloxypropylamide, 2-hydroxy-3-naphthalenesulfonic acid-2-ethylhexylamide, 5-acetamide-1-naphthol, sodium 1-hydroxy-8-acetamidenaphthalene-3,6-disulfonate, 1-hydroxy-8-acetamidenaphthalene-3,6-disulfonic acid dianilide, 1,5-dihydroxynaphthalene, 2-hydroxy-3-naphthoic acid morpholinopropylamide, 2-hydroxy-3-naphthoic acid octylamide, 2-hydroxy-3-naphthoic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis (octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2,4-bis-(benzoylacetamide)toluene, 1,3-bis-(pivaloylacetamidemethyl)benzene, benzoylacetonitrile, thenoylacetonitrile, acetoacetoanihde, benzoylacetoanilide, pivaloylacetoanilide, 2-chloro-5-(N-n-butylsulfamoyl)-1-pivaloylacetamidebenzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, and 1-(4-n-octyloxyphenyl)-3-tert-butyl-5-aminopyrazole, and the like.

For details of the above couplers, refer to JP-A Nos. 4-201483, 7-223367, 7-223368, 7-323660, 5-278608, 5-297024, 6-18669, 6-18670, 7-316280, 9-216468, 9-216469, 9-319025, 10-03513, 10-193801, 10-264532, and the like.

When combination (ii) (a diazonium salt compound and a coupler) is used as the color forming components, the contained amount of the diazonium salt compound in the recording layer is preferably 0.02 to 5.0 g/m$^2$, and more preferably 0.05 to 3.0 g/m$^2$. If the contained amount is less than 0.02 g/m$^2$, it may not be possible to obtain a sufficient formed color density. If the contained amount exceeds 5.0 g/m$^2$, the coating suitability of the coating solution may deteriorate.

The contained amount of the coupler is preferably 0.5 to 20 parts by mass, and more preferably 1 to 10 parts by mass, with respect to 1 part by mass of the diazonium salt compound. When the contained amount is less than 0.5 parts by mass, it may not be possible to obtain a sufficient formed color density, and when the contained amount exceeds 20 parts by mass, the suitability for coating may deteriorate.

The above coupler (together with other components which are added if desired) may be used by adding a water soluble polymer and dispersing the solids by a sand mill or the like. Or the coupler can be emulsified together with an appropriate emulsification aid, and used as an emulsion. The methods of dispersing the solids and emulsifying are not particularly limited, and conventionally known methods can be used. Details of these methods are disclosed in JP-A Nos. 59-190886, 2-141279, and 7-17145.

Organic Base

From the standpoint of promoting the coupling reaction between the diazonium salt compound and the coupler, it is preferable to use an organic base such as a tertiary amine, a piperidine, a piperazine, an amidine, a formamidine, a pyridine, a guanidine, a morpholine, or the like.

Examples of the organic base are piperazines such as N,N'-bis(3-phenoxy-2-hydroxypropyl)piperazine, N,N'-bis

[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine, 1,4-bis{[3-(N-methylpiperazino)-2-hydroxy]propyloxy}benzene, and the like; morpholines such as N-[3-(β-naphthoxy)-2-hydroxy]propylmorpholine, 1,4-bis[(3-morpholino-2-hydroxy)propyloxy]benzene, 1,3-bis[(3-morpholino-2-hydroxy)propyloxy]benzene, and the like; piperidines such as N-(3-phenoxy-2-hydroxypropyl)piperidine, N-dodecylpiperidine, and the like; triphenylguanidine, tricyclohexylguanidine, dicyclohexylphenylguanidine, 4-hydroxybenzoic acid 2-N-methyl-N-benzylaminoethylester, 4-hydroxybenzoic acid 2-N,N-di-n-butylaminoethylester, 4-(3-N,N-dibutylaminopropoxy) benzenesulfonamide, 4-(2-N,N-dibutylaminoethoxycarbonyl)phenoxyamide acetate, and the like.

A single one of these organic bases may be used, or two or more may be used in combination.

These organic bases are disclosed in JP-A Nos. 57-123086, 60-49991 and 60-94381, and Japanese Patent Application Nos. 7-228731, 7-235157 and 7-235158.

The amount of the organic base which is used is not particularly limited, but is preferably 1 to 30 mol with respect to 1 mol of the diazonium salt compound.

Color Forming Aid

A color forming aid can be added for the purpose of promoting the color forming reaction.

Examples of the color forming aid are phenol derivatives, naphthol derivatives, alkoxy substituted benzenes, alkoxy substituted naphthalenes, hydroxy compounds, amide carboxylate compounds, sulfonamide compounds, and the like.

Binder

The recording layer may contain a binder as well as the color forming component.

The binder is usually water soluble, and examples thereof include polyvinyl alcohol, hydroxyethyl cellulose, hydroxypropyl cellulose, ethylene—maleic anhydride copolymer, styrene—maleic anhydride copolymer, isobutylene—maleic anhydride copolymer, polyacrylic acid, starch derivatives, casein, gelatin, and the like.

The contained amount of the binder is preferably 10 to 30% by mass (dried mass) in the recording layer.

For the purpose of making the binder waterproof, a waterproofing agent (a gelling agent or a crosslinking agent) may be added, or a hydrophobic polymer emulsion, specifically, a styrene—butadiene rubber latex, an acrylic resin emulsion or the like, may be added.

Other Components

An antifoaming agent, a fluorescent dye, a coloring dye, an inorganic pigment, a wax, a higher fatty acid amide, a metal soap, an ultraviolet absorbent, an antioxidant, a latex binder, and the like may be added to the recording layer as needed. Further, it is effective to include in the recording layer or in the other layers any of various types of additives which are used in heat-sensitive recording materials and pressure-sensitive recording materials.

Examples of such additives are the compounds disclosed in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282, 63-051174, JP-B Nos. 48-043294, 48-033212, and the like.

Microcapsules

In order for the recording layer to form color when heat and/or pressure is applied thereto, it is preferable to impart a heat-responsive property and/or a pressure-responsive property to the color forming reaction of the color forming component. For example, by encapsulating one of the color forming components in heat-responsive and/or pressure-responsive microcapsules, the color forming reaction can be made to be heat-responsive and/or pressure-responsive.

Any of conventional, known methods can be used as the method for microencapsulating the color forming components. Examples are methods of utilizing coacervation of a hydrophilic wall-forming material disclosed in U.S. Pat. Nos. 2,800,457 and 2,800,458; the interfacial polymerization methods disclosed in U.S. Pat. No. 3,287, 154, British Patent No. 990443, JP-B Nos. 38-19574, 42-446 and 42-771; the methods by polymer precipitation disclosed in U.S. Pat. Nos. 3,418,250 and 3,660,304; the method using an isocyanatepolyol wall material disclosed in U.S. Pat. No. 3,796,669; the method using an isocyanate wall material disclosed in U.S. Pat. No. 3,914,511; the methods using urea—formaldehyde and urea formaldehyde—resorcinol wall forming materials disclosed in U.S. Pat. Nos. 4,001, 140, 4,087,376, and 4,089,802; the method using wall-forming materials of melamine—formaldehyde resin, hydroxypropyl cellulose, and the like disclosed in U.S. Pat. No. 4,025,455; the in situ methods by polymerization of monomers disclosed in JP-B No. 36-9168 and JP-A No. 51-9079; the electrolysis dispersing cooling methods disclosed in British Patent Nos. 952807 and 965074; the spray drying methods disclosed in U.S. Pat. No. 3,111,407 and British Patent No. 930422; and the like.

The method of microencapsulation is not limited to the aforementioned methods, and it is preferable to employ, for example, the following interfacial polymerization method. An oil phase is prepared by dissolving or dispersing, in a hydrophobic organic solvent which is to become the cores of the capsules, one color forming component (the electron donating dye precursor in the case of above combination (i), and the diazonium salt compound in the case of above combination (ii)). This oil phase is mixed together with a water phase in which a water soluble polymer is dissolved. The mixture is emulsified and dispersed by a means such as a homogenizer or the like. Thereafter, a polymer forming reaction is carried out at oil droplet interfaces by heating, such that a polymer substance microcapsule wall is formed. This interfacial polymerization method can form capsules of a uniform particle diameter within a short period of time, and can obtain a recording material having excellent raw stock storability.

In microcapsules which are preferable in the present invention, at room temperature, contact of substances at the interior and exterior of the capsules is impeded due to the substance separating effect of the microcapsule walls (hereinafter "capsule walls"). Only when heat and/or pressure of a given value or more is applied is contact of the substances at the interior and the exterior of the capsules possible. This phenomenon can be freely controlled by varying the properties of the capsules by appropriately selecting the material of the capsule wall, the capsule core substance (the substance encapsulated in the capsule), additives, and the like.

A reactant which forms the polymer substance is added to the interior of the oil droplet and/or to the exterior of the oil droplet. Specific examples of the polymer substance include polyurethane, polyurea, polyamide, polyester, polycarbonate, urea—formaldehyde resin, melamine resin, polystyrene, styrene—methacrylate copolymer, styrene—acrylate copolymer, and the like. Among these substances, polyurethane, polyurea, polyamide, polyester, and polycarbonate are preferable, and polyurethane and polyurea are particularly preferable. Two or more of the polymer substances may be used in combination.

At the time the microcapsuies are formed, the encapsulated color forming component may exist within the capsules in a solution state, or may exist in a solid state. When the color forming component is encapsulated in the capsules in a solution state, encapsulation may be carried out in a state in which the electron donating colorless dye or the diazonium salt compound which is the color forming component is dissolved in an organic solvent.

Generally, the organic solvent can be appropriately selected from among high boiling point solvents, and examples thereof include phosphoric ester, phthalic ester, acrylic ester, methacrylic ester, other carboxylic esters, fatty acid amides, alkylated biphenyl, alkylated terphenyl, chlorinated paraffin, alkylated naphthalene, diallyl ethane, compounds which are solids at normal temperature, oligomer oils, polymer oils, and the like. Specific examples are the organic solvents disclosed in JP-A Nos. 59-178451 through 59-178455, 59-178457, 60-242094, 63-85633, 6-194825, 7-13310, 7-13311, 9-106039 and Japanese Patent Application No. 62-75409.

The amount of the organic solvent used is preferably 1 to 500 parts by mass with respect to 100 parts by mass of the electron donating colorless dye or the diazonium salt compound.

Further, at the time of encapsulation, so-called oil-less capsules may be used without using an organic solvent.

In a case in which the solubility, in the organic solvent, of the electron donating colorless dye or diazonium salt compound which is to be encapsulated is low, a low boiling point solvent having high solubility can be used together with the organic solvent as an auxiliary solvent. Alternatively, it is possible to use a low boiling point solvent and not use the organic solvent.

Examples of low boiling point solvents include ethyl acetate, propyl acetate, isopropyl acetate, butyl acetate, methylene chloride, and the like.

Examples of water soluble polymers include polyvinyl alcohol, silanol denatured polyvinyl alcohol, carboxy denatured polyvinyl alcohol, amino denatured polyvinyl alcohol, itaconic acid denatured polyvinyl alcohol, styrene—maleic anhydride copolymer, butadiene—maleic anhydride copolymer, ethylene—maleic anhydride copolymer, isobutylene—maleic anhydride copolymer, polyacrylamide, polystyrene sulfonate, polyvinyl pyrrolidone, ethylene—acrylic acid copolymer, gelatin, and the like.

The water soluble polymer is used as an aqueous solution of 0.01 to 10% by mass.

The microcapsule wall can be formed as follows. For example, in a case in which polyurethane is used as the capsule wall material, polyhydric isocyanate and a second substance (e.g., polyol or polyamine), which reacts with the polyhydric isocyanate and forms the capsule wall, are mixed together in a water soluble polymer aqueous solution (water phase) or an oily medium to be encapsulated (oil phase). The mixture is emulsified and dispersed, and thereafter, by raising the temperature, a polymer-forming reaction takes place at the oil droplet interface such that the microcapsule wall is formed. Note that the particle diameter of the microcapsules is preferably 0.1 to 1.0 $\mu$m, and more preferably 0.2 to 0.7 $\mu$m.

Examples of other methods for making the color forming reaction heat-responsible are a method of mixing a low boiling point heat fusible substance with one of the color forming components (e.g., the electron receiving compound in above combination (i), or the coupler in above combination (ii), hereinafter referred to upon occasion as the "developer") and adding the mixture into the recording layer as a eutectic; and a method of adding, to the recording layer, a low boiling point compound which is in a state of being fused to the surface of developer particles.

Waxes are examples of materials used for the low boiling point compound. Examples of waxes are paraffin wax, carnauba wax, microcrystalline wax, polyethylene wax, and the like. Other examples include higher fatty acid amides such as amide stearate, ethylene bis stearoamide, and the like, and higher fatty acid esters, and the like.

(Formation of Recording Layer)

The recording layer can be formed by applying, on a resin layer, and drying a coating solution in which the color forming component, and if desired, other components to be added such as a binder or the like, are dissolved and/or dispersed in a solvent. The solvent is preferably water, but an organic solvent which can be mixed with water, such as alcohol, a ketone, or the like, can be used together with water.

Any of conventional, known coating methods, such as a blade coating method, an air knife coating method, a gravure coating method, a roll coating method, a spray coating method, a dip coating method, a bar coating method, an extrusion coating method, or the like, can be used as the method of coating the coating solution.

The coated amount of the coating solution forming the recording layer is not particularly limited, but usually a dried mass of 3 to 15 g/m$^2$ is preferable, and 4 to 10 g/m$^2$ is more preferable.

[Other Layers]

In the recording material of the present invention, if desired, an intermediate layer may be provided between two recording layers, and a protective layer and an ultraviolet light (light transmittance) adjusting layer maybe provided on the recording layer. For the materials contained in the respective layers and arrangements of the respective layers, the examples of materials and arrangements disclosed in columns 39 through 60 of JP-A No. 11-34495 can be applied to the recording material of the present invention. Further, a resin covering layer, which contains, for example, a hardening agent, and which prevents deformation of the support and suppresses blistering, may be provided between the support and the recording layer if desired in the recording material of the present invention.

(Protective Layer)

A protective layer containing a pigment and a mold releasing agent may be provided on the recording layer for the purpose of protecting the recording layer from sticking or solvents or the like. The protective layer contains a binder, a pigment (an inorganic laminar compound such as mica or the like, or calcium oxide, zinc oxide, titanium oxide, aluminum hydroxide, kaolin, synthetic silicate, amorphous silica, urea formalin resin powder, or the like), a lubricant, a surfactant, and the like. If necessary, the protective layer may contain a crosslinking agent, a matte agent, a mold releasing agent, a dispersion stabilizer, a water repelling agent, and the like. The protective layer may have a single layer structure, or may have a laminated structure of two or more layers.

(Light Transmittance Adjusting Layer)

At least one light transmittance adjusting layer can be provided in the recording material. The light transmittance adjusting layer is preferably formed between the recording layer and the outermost protective layer. However, the light transmittance adjusting layer can also serve as a protective layer. The characteristics of the light transmittance adjusting layer may be arbitrarily selected in accordance with the characteristics of the light fixing type recording layer.

The light transmittance adjusting layer contains a component which functions as a precursor of an ultraviolet absorbent, and does not function as an ultraviolet absorbent before illumination of light of a wavelength in a region necessary for fixing. Thus, the light transmittance is high, and when the light fixing type recording layer is fixed, light of a wavelength in a region needed for fixing sufficiently passes through. Further, the transmittance of visible light is high, and no obstacles to fixing of the recording layer arise.

After illumination of light of a wavelength in a region necessary for fixing by illumination light onto the light fixing type recording layer is completed, the precursor of the ultraviolet absorbent reacts due to the light or heat so as to function as an ultraviolet absorbent. The majority of the light of a wavelength in a region, necessary for fixing, of the ultraviolet region is absorbed by the ultraviolet absorbent, and the transmittance becomes low and the light resistance of the recording material improves. Because there is no effect of absorbing visible light, the transmittance of visible light substantially does not change. Examples of precursors of ultraviolet light absorbents are the compounds disclosed in JP-A No. 9-1928.

[Support]

Examples of supports used in the recording material are various supports such as paper supports like base paper, synthetic paper, and the like, plastic film supports, and the like.

The base paper used as the paper support may contain, as the main material thereof, a natural pulp selected from coniferous trees, broad-leaved trees, or the like, and may contain other components. Examples of other components include sizing agents, softening agents, paper reinforcers, fixing agents, and fillers.

Examples of the sizing agent include rosin, paraffin wax, higher fatty acid salts, alkenyl succinic acid salt, fatty acid anhydrides, styrene maleic anhydride copolymer, alkyl ketene dimer, epoxidated fatty acid amides, and the like. Examples of the softening agent include reaction products of maleic anhydride copolymer and polyalkylene polyamine, quaternary ammonium salts of higher fatty acids, and the like. Examples of the paper reinforcer include polyacrylamide, starch, polyvinyl alcohol, melamine formaldehyde condensation product, gelatin, and the like. Examples of the fixing agent include aluminum sulfate, polyamide polyamine epichlorohydrine, and the like. Examples of the filler include clay, talc, calcium carbonate, urea resin particulates, and the like. In addition, dyes, fluorescent dyes, antistatic agents and the like may be added if needed.

As the paper support, a synthetic paper using a synthetic pulp in place of natural pulp may be used. Or a synthetic paper in which natural pulp and synthetic pulp are mixed together in an arbitrary ratio may be used. Among these, it is preferable to use coniferous tree pulp which is formed from short fibers and has a greater flatness. The hydrature of the pulp material which is used is preferably 200 to 500 cc (C.S.F.), and more preferably 300 to 400 cc.

Examples of the plastic support include known films such as polyethylene film (either high density or low density), polypropylene film, acetate film, polyvinylchloride film, polyvinylidene chloride film, polystyrene film, polyester film, polycarbonate film, nylon film, polybutylene film, polyurethane film, acrylic film, and the like.

The support of the recording material of the present invention is preferably a support formed by both sides of a base paper being covered by polyolefin layers. When a support in which both sides of a base paper are covered by polyolefin layers is used, the surface flatness of the support improves, and differences in the thickness at image portions (so-called blistering), which differences are caused by the image density, can be reduced even more, and such a structure is therefore preferable. Examples of the polyolefin resin which covers the base paper are polyethylene, polypropylene, 4-methylpentene-1 resin, polybutene-1 resin, and the like.

The polyolefin layer can be formed at each surface of the base paper by laminating processing. The laminating processing can be appropriately selected from known methods such as those disclosed in "New Laminating Handbook" ("*Shin Ramineto Kakou Binran*") edited by the Processing Technology Research Association (*Kakou Gijutsu Kenkyuukai*). Methods such as so-called dry lamination, solvent-less-type dry lamination, hot melt lamination and the like can be used. For example, in a case in which the polyolefin layer is formed by dry lamination, the layer can be formed by coating an adhesive on one surface of a polyolefin resin film, drying as desired, and thermally pressure-adhering the film to the surface of a base paper. Examples of the adhesive are solvent-type vinyl resins, acrylic resins, polyamide resins, epoxy resins, rubber resins, urethane resins, and the like. Further, the front surface and/or the reverse surface of the base paper may be subjected to a corona discharge treatment so as to improve the adhesion with the polyolefin layer.

Hereinafter, specific structural examples of the recording material relating to the present invention will be described.

The recording material of the present invention may be a multicolor recording material having a layered structure in which a plurality of single-color recording layers are layered. The multicolor recording material is preferably a structure in which at least one layer forming the recording layer is a light fixing type recording layer containing a diazonium salt compound and a coupler which colors upon reaction with the diazonium salt compound. Recording materials structured as following (a) through (c) are examples.

(a) a recording material having, on a support, a recording layer in which are layered a light fixing type recording layer (a first recording layer (layer A)) which contains a diazonium salt compound whose wavelength of maximum absorption is 360±20 nm and a coupler which colors upon reaction with this diazonium salt compound, and a light fixing type recording layer (a second recording layer (layer B)) which contains a diazonium salt compound whose wavelength of maximum absorption is 400±20 nm and a coupler which colors upon reaction with this diazonium salt compound; and on this layer are provided, if necessary, a light transmittance adjusting layer and a protective layer;

(b) a recording material having, on a support, a recording layer in which are layered in the following order a recording layer (a first recording layer (layer A)) which contains an electron donating dye and an electron receiving compound, a light fixing type recording layer (a second recording layer (layer B)) which contains a diazonium salt compound whose wavelength of maximum absorption is 360±20 nm and a coupler which colors upon reaction with this diazonium salt compound, and a light fixing type recording layer (a third recording layer (layer C)) which contains a diazonium salt compound whose wavelength of maximum absorption is 400±20 nm and a coupler which colors upon reaction with this diazonium salt compound; and on this layer are provided, if necessary, a light transmittance adjusting layer and a protective layer;

(c) a recording material having, on a support, a recording layer in which are layered in the following order a light fixing type recording layer (a first recording layer (layer A)) which contains a diazonium salt compound whose wavelength of maximum absorption is 340±20 nm or less and a coupler which colors upon reaction with this diazonium salt compound, a light fixing type recording layer (a second recording layer (layer B)) which contains a diazonium salt compound whose wavelength of maximum absorption is 360±20 nm and a coupler which colors upon reaction with this diazonium salt compound, and a light fixing type recording layer (a third recording layer (layer C)) which contains a diazonium salt compound whose wavelength of maximum absorption is 400±20 nm and a coupler which colors upon reaction with this diazonium salt compound; and on this layer are provided, if necessary, a light transmittance adjusting layer and a protective layer.

The method of multicolor recording will be described hereinafter with reference to above (b) or (c).

First, the third recording layer (layer C) is heated, and the diazonium salt and the coupler contained in this layer form a color. Next, light of a wavelength of 400±20 nm is illuminated, and the unreacted diazonium salt compound contained in layer C decomposes and is light-fixed. Thereafter, heat which is sufficient for the second recording layer (layer B) to form color is applied, and the diazonium salt compound and the coupler contained in this layer form color. At this time, layer C also is simultaneously heated strongly, but the diazonium salt compound has already decomposed (has already been light-fixed). Because the color forming ability has been lost, layer C does not color. Further, light of a wavelength of 360±20 nm is illuminated, and the diazonium salt compound contained in layer B decomposes and is light-fixed. Thereafter, finally, heat which is sufficient for the first recording layer (layer A) to form color is applied, and layer A is made to form color. At this time, the recording layers which are layer C and layer B are also strongly heated at the same time, but since the diazonium salt compounds therein have already decomposed, their color forming ability has been lost, and these layers do not form color.

As the order of layering the respective layers, using the yellow layer, whose luminosity is lowest, as the lowermost layer enables a reduction in the effects on image quality caused by roughness of the support surface and is effective particularly in cases in which an improvement in image quality is aimed for.

Further, when all of the recording layers (layer A, layer B, layer C) are diazo based recording layers, for layers A and B, there is the need to carry out light fixing after color formation. However, for layer C at which image recording is carried out last, it is not absolutely necessary to carry out light fixing. However, from the standpoint of improving storage stability of the formed imaged, it is preferable to carry out light fixing.

The light source for fixing which is used in light fixing can be appropriately selected from known light sources. Examples include various fluorescent lamps, xenon lamps, mercury lamps, and the like. From the standpoint of carrying out light fixing with high efficiency, it is preferable to use a light source whose light emission spectrum substantially matches the absorption spectrum of the diazonium salt compound used in the recording material.

The recording material of the present invention may be used as a heat developing type photosensitive material in which, first, exposure through an original above a recording layer of the recording material is carried out, and the diazonium salt compound at portions other than image portions, i.e., at the non-image portions, decomposes and a latent image is formed, and thereafter, the entire recording material is heated such that an image is formed.

EXAMPLES

Hereinafter, the present invention will be described with reference to Examples. However, the present invention is not limited to these Examples. Hereinafter, the "parts" and "%" in the Examples respectively represent "parts by mass" and "% by mass".

Example 1

<<Preparation of Recording Material>>

The recording material of Example 1 is prepared by providing a resin layer (an undercoat layer) on a support, and coating a recording layer and the like on the resin layer (the undercoat layer). Hereinafter, the processes of preparing the recording material will be described in order.

Preparation of Resin Layer (Undercoat Layer)

(Preparation of Coating Solution for Undercoat Layer)

First, 20 parts of polyvinyl alcohol (partially saponified PVA, degree of saponification: 87 to 89 mol %, degree of polymerization: 1000, trade name: PVA-210, manufactured by Kuraray Co., Ltd.) and 80 parts of water were added, and were stirred and dissolved at 90° C. so as to form a PVA solution.

Separately, 8 parts of water swellable synthetic mica (aspect ratio: 1000, trade name: SOMASHIF ME10, manufactured by Co-op Chemical Co., Ltd.) and 92 parts water were mixed together, and thereafter, were wet dispersed in a viscomill such that a mica dispersed liquid of an average particle diameter of 2.0 $\mu$m was obtained. Water was added to the dispersed liquid such that the concentration of mica became 5%, and the solution was mixed uniformly to obtain a mica dispersed liquid.

Then, 10 parts water and 510 parts methanol (water/methanol=60/40) were added to 100 parts of the above 20% PVA solution at 90° C., and the resultant solution was sufficiently stirred and mixed at 40° C. Thereafter, 267 parts of the above 5% mica dispersed liquid was added, the resultant mixture was sufficiently stirred and mixed, and 4.8 parts of a 1.66% surfactant was added. Next, the liquid temperature was maintained at 35° C. to 40° C., and 0.2 parts of a hardening agent was added, such that a coating solution (3.8%) for undercoat layer whose water/methanol ratio was 40/60 was obtained.

While the obtained coating solution for undercoat layer was adjusted such that the PVA coated amount was 0.75 g/m$^2$, the coating solution was applied onto a support for a photographic printing paper, in which a polyester film was laminated on each side of high quality paper, so as to form the undercoat layer. At this time, the coated amount of the water swellable synthetic mica was 0.5 g/m$^2$, and the mass ratio of the PVA and the mica was 1.5.

Formation of Recording Layer and the Like (Preparation of Coating Solution A for Recording Layer)

Preparation of Electron Donating Dye Precursor Capsule Liquid

As the electron donating dye precursor, 3.0 parts of crystal violet lactone was dissolved in 20 parts of ethyl acetate. 20 parts of alkyl naphthalene, which is a high boiling solvent, was added, and the resultant mixture was heated and mixed uniformly. As the capsule wall agent, 20 parts of a xylene diisocyanate/trimethylol propane addition product was added to this solution, and the resultant mixture was stirred uniformly. Separately, 54 parts of a 6% by mass aqueous solution of gelatin was readied, the previous electron donating dye precursor solution was added thereto, and the mixture was emulsified and dispersed by a homogenizer. 68 parts water was added to the obtained emulsion liquid, and the mixture was made uniform. Thereafter, while stirring was carried out, the temperature was raised to 50° C., and an encapsulating reaction was carried out for 3 hours, such that an electron donating dye precursor capsule liquid was obtained. The average particle diameter of the capsules was 1.6 μm.

Preparation of Electron Receiving Compound Dispersed Liquid

As the electron receiving compound, 30 parts of bisphenol A was added to 150 parts of a 4% by mass aqueous solution of gelatin, and the resultant mixture was dispersed for 24 hours by a ball mill so as to prepare the electron receiving compound dispersed liquid. The average particle diameter of the electron receiving compound in the dispersed liquid was 1.2 μm.

Preparation of Coating Solution

The above electron donating dye precursor capsule liquid and electron receiving compound dispersed liquid were mixed together such that the ratio of the electron donating dye precursor/electron receiving compound was 1/2, and the target coating solution A was prepared.

(Preparation of Coating Solution B for Recording Layer)

Preparation of Diazonium Salt Compound Capsule Liquid b

As the diazonium salt compound, 2.0 parts of 4-(N-2-(2,4-di-tert-amylphenoxy)butyryl) piperazinobenzenediazoniumhexafluorophosphate was dissolved in 20 parts of ethyl acetate. 20 parts of alkyl naphthalene, which is a high boiling point solvent, was added thereto, and the resultant mixture was heated and mixed uniformly. As the capsule wall agent, 15 parts of a xylylene diisocyanate/trimethylol propane addition product was added to this solution, and the resultant mixture was stirred uniformly. Separately, 54 parts of a 6% by mass aqueous solution of gelatin was readied, and was added to the diazonium salt compound solution, and the mixture was emulsified and dispersed by a homogenizer. 68 parts water was added to the obtained emulsion liquid, and the mixture was made uniform. Thereafter, while stirring was carried out, the temperature was raised to 40° C., an encapsulating reaction was carried out for 3 hours, and a diazonium salt compound capsule liquid b was obtained. The average particle diameter of the capsules was 1.1 μm.

Preparation of Coupler Emulsion Liquid b

As the coupler, 2 parts of 1-(2'-octylphenyl)-3-methyl-5-pyrazolone, 2 parts of 1,2,3-triphenylguanidine, 2 parts of 1,1-(p-hydroxyphenyl)-2-ethylhexane, 4 parts of 4,4'-(p-phenylenediisopropylidine)diphenol, 4 parts of 2-ethylhexyl-4-hydroxybenzoate, 0.3 parts of tricresylphosphate, 0.1 parts of diethyl maleate, and 1 part of a 70% calcium dodecylbenzenesulfonate methanol solution were dissolved in 10 parts ethyl acetate. 80 parts of an 8% gelatin aqueous solution were added to this solution, and the mixture was emulsified for 10 minutes in a homogenizer. Thereafter, the ethyl acetate was removed to obtain coupler emulsion liquid b.

Preparation of Coating Solution

The above diazonium salt compound capsule liquid b and coupler emulsion liquid b were mixed together such that the diazonium salt compound/coupler ratio was 2/3, and the object coating solution B was prepared.

(Preparation of Coating Solution C for Recording Layer)

Preparation of Diazonium Salt Compound Capsule Liquid c

As the diazonium salt compound, 3.0 parts of 2,5-dibutoxy-4-tolylthiobenzenediazoniumhexafluorophosphate was dissolved in 20 parts of ethyl acetate. 20 parts of alkyl naphthalene, which is a high boiling point solvent, was added thereto, and the resultant mixture was heated and mixed uniformly. As the capsule wall agent, 15 parts of a xylylene diisocyanate/trimethylol propane addition product was added to this solution, and the resultant mixture was stirred uniformly. Separately, 54 parts of a 6% aqueous solution of gelatin was readied, and was added to the diazonium salt compound solution, and the mixture was emulsified and dispersed by a homogenizer. 68 parts water was added to the obtained emulsion liquid, and the mixture was made uniform. Thereafter, while stirring was carried out, the temperature was raised to 40° C., an encapsulating reaction was carried out for 3 hours, and a diazonium salt compound capsule liquid c was obtained. The average particle diameter of the capsules was 1.0 μm.

Preparation of Coupler Emulsion Liquid c

As the coupler, 2 parts of 2-chloro-5-(3-(2,4-di-tert-pentyl)phenoxypropylamino)acetoacetoanilide, 2 parts of 1,2,3-triphenylguanidine, 2 parts of 1,1-(p-hydroxyphenyl)-2-ethylhexane, 4 parts of 4,4'-(p-phenylenediisopropylidene)diphenol, 4 parts of 2-ethylhexyl-4-hydroxybenzoate, 0.3 parts of tricresylphosphate, 0.1 parts of diethyl maleate, and 1 part of a 70% calcium dodecylbenzenesulfonate methanol solution were dissolved in 10 parts ethyl acetate. 80 parts of an 8% gelatin aqueous solution were added to this solution, and the mixture was emulsified for 10 minutes in a homogenizer. Thereafter, the ethyl acetate was removed to obtain coupler emulsion liquid c.

Preparation of Coating Solution

The above diazonium salt compound capsule liquid c and coupler emulsion liquid c were mixed together such that the diazonium salt compound/coupler ratio was 4/5, and the object coating solution C was prepared.

(Preparation of Coating Solution for Light Transmittance Adjusting Layer)

Preparation of UV Absorbent Precursor Capsule Liquid

As a UV absorbent precursor, 10 parts of [2-aryl-6-(2H-benzotriazole-2-yl) -4-t-octylphenyl]benzenesulfonate, 3 parts of 2,5-di-t-octyl-hydroquinone, 2 parts of tricresylphosphate, and 4 parts of α-methyl styrene dimer were dissolved in 30 parts of ethyl acetate. As a capsule wall agent, 20 parts of a xylylene diisocyanate/trimethylol propane addition product was added to this solution, and the resultant solution was stirred uniformly such that a UV absorbent precursor solution was obtained.

Separately, 200 parts of an 8% itaconic acid denatured polyvinyl alcohol aqueous solution was readied, and the above UV absorbent precursor solution was added thereto. The resultant mixture was emulsified and dispersed in a homogenizer. 120 parts water was added to the obtained emulsion, and the solution was made uniform. Thereafter, while stirring was carried out, the temperature was raised to 40° C., and an encapsulating reaction was carried out for 3 hours so as to obtain a UV absorbent precursor encapsulating microcapsule liquid. The average particle diameter of the microcapsules was 0.3 μm.

Preparation of Coating Solution 10 parts of a 2% aqueous solution of sodium [4-nonylphenoxytrioxyethylene]butyl sulfonate was added to 100 parts of the above UV absorbent precursor encapsulating microcapsule liquid, and a coating solution for the light transmittance adjusting layer was obtained.

(Preparation of Coating Solution for Intermediate Layer)

2 parts of 2% sodium (4-nonylphenoxytrioxyethylene) butyl sulfonate was added to 100 parts of a 10% gelatin aqueous solution, so as to prepare a coating solution for intermediate layer.

(Preparation of Coating Solution for Protective Layer)

2.0 parts of a 20.5% zinc stearate dispersion liquid (HYDRINE F115, manufactured by Chukyo Yushi KK) were added to 61 parts of a 5.0% ethylene denatured polyvinyl alcohol aqueous solution. Further, 8.4 parts of a 2% aqueous solution of sodium (4-nonylphenoxytrioxyethylene)butyl sulfonate, 8.0 parts of a fluorine based mold releasing agent (ME-313, manufactured by Daikin KK), and 0.5 parts of wheat flour starch were added thereto, and the mixture was stirred uniformly so as to prepare liquid A.

Separately, 12.5 parts of a 20% aqueous solution of KAOGROS (manufactured by Shiraishi Kogyo KK), 1.25 parts of a 10% aqueous solution of polyvinyl alcohol (PVA105, manufactured by Kuraray Co., Ltd.), and 0.39 parts of a 2% aqueous solution of sodium dodecylsulfonate were mixed together, and dispersed in a dynomill so as to prepare liquid B.

4.4 parts of liquid B were added to 80 parts liquid A, so as to prepare the coating solution for a protective layer.

(Coating)

The coating solution A for recording layer, the coating solution for intermediate layer, the coating solution B for recording layer, the coating solution for intermediate layer, the coating solution C for recording layer, the coating solution for the light transmittance adjusting layer, and the coating solution for the protective layer were continuously coated at a coating speed of 60 m/min, in that order from the resin layer, on the resin layer of a support whose resin layer (undercoat layer) was formed as described above, such that seven layers were formed simultaneously. The structure was dried under conditions of 30° C. and 30%, and of 40° C. and 30%, so as to prepare the recording material (1) of the present invention. Here, the coated amounts of solids of the respective layers were 6.0 g/m$^2$ for the recording layer A, 3.0 g/m$^2$ for the intermediate layer, 6.0 g/m$^2$ for the recording layer B, 3.0 g/m$^2$ for the intermediate layer, 5.0 g/m$^2$ for the recording layer C, 3.0 g/m$^2$ for the transmittance adjusting layer, and 1.5 g/m$^2$ for the protective layer.

Example 2

A heat-sensitive recording material was prepared in the same way as in Example 1, except that the PVA included in the undercoat layer of Example 1 was changed from PVA-210 to PVA-205 (cationic PVA, degree of saponification: 86.5 to 89.5 mol %, degree of polymerization: 500, manufactured by Kuraray Co., Ltd.) and the mass ratio of the PVA and the water swellable synthetic mica was changed to 20. At this time, adjustment was carried out such that the coated amount of PVA was 2.0 g/m$^2$. The coated amount of the water swellable synthetic mica was 0.1 g/m$^2$.

Example 3

A heat-sensitive recording material was prepared in the same way as in Example 1, except that the PVA included in the undercoat layer of Example 1 was changed from PVA-210 to SMR-10L (degree of saponification: 35 mol %, degree of polymerization: 240, manufactured by Shin-Etsu Chemical Co., Ltd.), the mass ratio of the PVA and the water swellable synthetic mica was changed to 4.0, and a coating solution (5.2%) for undercoat layer was obtained. At this time, adjustment was carried out such that the coated amount of PVA was 1.0 g/m$^2$. The coated amount of the water swellable synthetic mica was 0.25 g/m$^2$.

Example 4

A heat-sensitive recording material was prepared in the same way as in Example 1, except that the PVA included in the undercoat layer of Example 1 was changed from PVA-210 to SMR-10M (degree of saponification: 65 mol %, degree of polymerization: 240, manufactured by Shin-Etsu Chemical Co., Ltd.), the mass ratio of the PVA and the water swellable synthetic mica was changed to 4.0, and a coating solution (5.2%) for undercoat layer was obtained. At this time, adjustment was carried out such that the coated amount of PVA was 1.0 g/m$^2$. The coated amount of the water swellable synthetic mica was 0.25 g/m$^2$.

Example 5

A heat-sensitive recording material was prepared in the same way as in Example 1, except that the PVA included in the undercoat layer of Example 1 was changed from PVA-210 to PVAC-506 (cationic PVA, degree of saponification: 74 to 80 mol %, degree of polymerization: 600, manufactured by Kuraray Co., Ltd.), the mass ratio of the PVA and the water swellable synthetic mica was changed to 5.0, and a coating solution (5.5%) for undercoat layer was obtained. At this time, adjustment was carried out such that the coated amount of PVA was 0.75 g/m$^2$. The coated amount of the water swellable synthetic mica was 0.15 g/m$^2$.

Example 6

A heat-sensitive recording material was prepared in the same way as in Example 5, except that the mass ratio of the PVA and the water swellable synthetic mica in the undercoat layer was changed to 6.0, and a coating solution (5.8%) for undercoat layer was obtained. At this time, adjustment was carried out such that the coated amount of PVA was 1.5 g/m$^2$. The coated amount of the water swellable synthetic mica was 0.25 g/m$^2$.

Comparative Example 1

A heat-sensitive recording material was prepared in the same way as in Example 1, except that the coating solution for the undercoat layer in Example 1 was changed to the following coating solution for an undercoat layer relating to Comparative Example 1. At this time, the mass ratio of the gelatin and the water swellable synthetic mica was 4.0, and adjustment was carried out such that the coated amount of the gelatin was 1.0 g/m$^2$. The coated amount of the water swellable synthetic mica was 0.25 g/m$^2$.

(Preparation of Coating Solution for Undercoat Layer Relating to Comparative Example 1)

First, 40 parts of gelatin (degree of polymerization: about 10,000 or more; trade name: 881 GELATIN, manufactured by Nitta Gelatin KK) and 60 parts of water were added, and were stirred and dissolved at 40° C. so as to obtain a gelatin solution.

Separately, 8 parts of a water swellable synthetic mica (aspect ratio: 1000; trade name: SOMASHIF ME10, manufactured by Co-op Chemical Co., Ltd.) and 92 parts water were mixed together, and thereafter, were wet dispersed in a viscomill to obtain a mica dispersed liquid having an average particle diameter of 2.0 μm. Water was added to this dispersed liquid so that the concentration of the mica was 5%, and the mixture was stirred uniformly to obtain a mica dispersed liquid.

Next, 31 parts water and 463 parts methanol were added to 100 parts of the above 40% gelatin solution at 40°, and sufficient stirring and mixing were carried out at 40°. Thereafter, 200 parts of the above 5% mica dispersed liquid were added, sufficient mixing and stirring were carried out, and 10 parts of a 1.66% surfactant were added. Next, the liquid temperature was maintained at 38° C. to 42° C., and 0.4 parts of a gelatin hardening agent was added, and a coating solution (6.3%) for undercoat layer relating to Comparative Example 1 was obtained.

Comparative Example 2

A heat sensitive recording material was prepared in the same way as Example 3, except that the PVA contained in the undercoat layer in Example 3 was changed from SMR-10L to SMR-8L (degree of saponification: 10 mol % or less, degree of polymerization: 180, manufactured by Shin-Etsu Chemical Co., Ltd.) and the mass ratio of the PVA and the water swellable synthetic mica was changed to 4.0. At that time, the coated amount of the PVA was adjusted to 1.0 g/m$^2$, and the coated amount of the water swellable synthetic mica was 0.25 g/m$^2$.

Comparative Example 3

A heat sensitive recording material was prepared in the same way as Example 3, except that the PVA contained in the undercoat layer in Example 3 was changed from SMR-10L to PVA-105 (degree of saponification: 98 to 99 mol %, degree of polymerization: 500, manufactured by Kuraray Co., Ltd.) and the mass ratio of the PVA and the water swellable synthetic mica was changed to 4.0. At that time, the coated amount of the PVA was adjusted to 1.0 g/m$^2$, and the coated amount of the water swellable synthetic mica was 0.25 g/m$^2$.

Comparative Example 4

A heat sensitive recording material was prepared in the same way as Example 3, except that the PVA contained in the undercoat layer in Example 3 was changed from SMR-10L to PVA-110 (degree of saponification: 98 to 99 mol %, degree of polymerization: 1000, manufactured by Kuraray Co., Ltd.) and the mass ratio of the PVA and the water swellable synthetic mica was changed to 4.0. At that time, the coated amount of the PVA was adjusted to 1.0 g/m$^2$, and the coated amount of the water swellable synthetic mica was 0.25 g/m$^2$.

Comparative Example 5

A heat sensitive recording material was prepared in the same way as Example 3, except that the PVA contained in the undercoat layer in Example 3 was changed from SMR-10L to PVA-117 (degree of saponification: 98 to 99 mol %, degree of polymerization: 1700, manufactured by Kuraray Co., Ltd.) and the mass ratio of the PVA and the water swellable synthetic mica was changed to 4.0. At that time, the coated amount of the PVA was adjusted to 1.0 g/m$^2$, and the coated amount of the water swellable synthetic mica was 0.25 g/m$^2$.

<<Evaluations Relating to Examples 1 through 5>>

(Evaluation of Blistering)

With the conditions shown in following Table 1 as maximum output, the output was successively lowered, and for each output, a black solid mark was recorded on a comparative sample (THERMO-AUTOCHROME PAPER RA 5-G100, manufactured by Fuji Photo Film Co., Ltd.) by using the above digital printer. Next, each of the comparative samples was cut, the cut surface was viewed, and the state of occurrence of blistering was measured.

A mark of 1 point was given to the surface state level of a comparative sample which was recorded at the maximum output and at which there was the most blistering. A mark of 5 points was given to the surface state level of a comparative sample at which no occurrence of blistering at all was observed. Marks of 2 through 4 points were appropriately given to surface state levels of comparative samples which were recorded at outputs between the highest output of the comparative sample at which no blistering at all was observed, and the maximum output. Evaluations of 3 points or more mean surface state levels which do not present problems in practice.

Next, the recording materials of Examples 1 through 6 and Comparative Examples 1 through 5, on which black solid marks were recorded in the above blister test, were cut, the cut surfaces thereof were viewed, and the states of occurrence of blistering were measured. These cut recording materials were compared with the comparative samples, and were evaluated and given the surface state level of the comparative sample having the closest state of occurrence of blistering. The evaluations of the respective recording materials are shown in Table 2.

TABLE 1

| | Line period | Applied voltage | Energization time |
|---|---|---|---|
| Yellow | 7.6 ms/line | 19 V | 4167 μs |
| Magenta | 7.6 ms/line | 21 V | 5320 μs |
| Cyan | 13.3 ms/line | 22 V | 8031 μs |

(Evaluation of Solubility and Dispersibility of Liquid for Coating of Undercoat Layer)

The solubility and dispersibility of the PVA or gelatin and the water swellable synthetic mica in the coating solution for the undercoat layer of Examples 1 through 6 and Comparative Examples 1 through 5 were evaluated as follows. First, several milliliters of the coating solution for undercoat layer was placed in drops onto a glass plate. When the water film formed, it was observed whether there were agglomerates or insoluble matter in the dispersed liquid, and evaluation was carried out in accordance with the following criteria. The results for each of the recording materials are shown in Table 2.

Criteria

○: There were absolutely no agglomerates and insoluble matter.

×: Agglomerates and insoluble matter were observed.

TABLE 2

| | Trade name | Degree of saponification (mol %) | Degree of polymerization | Coated amount of PVA (g/m$^2$) | PVA (gelatin)/mica ratio | Evaluation of blistering | Solubility and dispersability |
|---|---|---|---|---|---|---|---|
| Example 1 | PVA-210 | 87–89 | 1000 | 0.75 | 1.5 | 3.5 | ○ |
| Example 2 | PVA-205 | 86.5–89.5 | 500 | 2.0 | 20.0 | 4 | ○ |
| Example 3 | SMR-10L | 35 | 240 | 1.0 | 4.0 | 3.5 | ○ |
| Example 4 | SMR-10M | 65 | 240 | 1.0 | 4.0 | 4 | ○ |
| Example 5 | PVAC-506 | 74–80 | 600 | 0.75 | 5.0 | 5 | ○ |
| Example 6 | PVAC-506 | 74–80 | 600 | 1.5 | 6.0 | 5 | ○ |
| Comparative Example 1 | 881 GELATIN | | about 10000 | 1 | 4.0 | 1 | ○ |
| Comparative Example 2 | SMR-8L | 10 or less | 180 | 1 | 4.0 | evaluation not possible | X |
| Comparative Example 3 | PVA-105 | 98–99 | 500 | 1 | 4.0 | 2 | ○ |
| Comparative Example 4 | PVA-110 | 98–99 | 1000 | 1 | 4.0 | 1 | increased viscosity X |
| Comparative Example 5 | PVA-117 | 98–99 | 1700 | 1 | 4.0 | 1 | increased viscosity X |

From Table 2, it can be seen that, with recording materials using PVA whose degree of saponification fell within a range of 30 mol % to 90 mol %, the occurrence of blistering was suppressed. Further, in Comparative Example 2 which used a PVA whose degree of saponification was 10 mol % or less, because there was coagulated matter at the time of preparation of the coating solution, the coating solution could not be prepared, and blistering could not be evaluated.

As is shown by Examples 1 through 5, the recording material of the present invention has, between the support and the recording layer, at least one layer containing polyvinyl alcohol having a degree of saponification of 30 mol % to 90 mol %. Thus, it is possible to provide a recording material in which the occurrence of blistering at the time of recording is suppressed, the flatness of the image portions is good, and high quality images having a good degree of gloss can be formed.

Example 7

Preparation of Support

Wood pulp formed of 40 parts LBSP and 60 parts LBKP was refined by a disk refiner to a Canadian Freeness of 300 cc. 0.5 parts of epoxidated amide behenate, 1.0 parts of anionic polyacrylamide, 1.0 parts of aluminum sulfate, 0.1 parts of polyamide polyamine epichlorohydrine, and 0.5 parts of cationic polyacrylamide were added thereto, each in an absolute dried mass ratio with respect to the pulp, and a base paper with a weight of 100 g/m$^2$ was manufactured by using a fourdrinier machine.

Anatase type titanium dioxide was contained in a low density polyethylene in an amount of 10%, and a polyethylene film which was adjusted to a thickness of 50 $\mu$m was readied. A polyurethane two-liquid type adhesive having the following composition was coated to 3 g/m$^2$ on one surface of this polyethylene film, and was dried at 100° C. for 2 minutes. This structure was adhered onto the base paper, and heating and pressure-adhesion at a temperature of 40° C. and a pressure of 20 kg/cm$^2$ were carried out.

adhesive:

POLYBOND AY-651A (manufactured by Sanyo Chemical Co., Ltd.) . . . 100 parts

POLYBOND AY-651C (manufactured by Sanyo Chemical Co., Ltd.) . . . 15 parts

The surface of the base paper opposite to the surface to which the polyethylene film was adhered (this surface to which the polyethylene film was adhered is referred to as "the front surface"), was subjected to a corona discharge treatment. Then, by using a melt extruder, a high density polyethylene was coated until the resin thickness was 30 $\mu$m, and a resin layer formed from a matte surface was formed. (This surface is referred to as "the reverse surface".) After the surface of the polyethylene resin layer at the reverse surface was subjected to a corona discharge treatment, as an antistatic agent, aluminum sulfate (ALUMINAZOL 100, manufactured by Nissan Kagaku Kogyo KK)/silicon dioxide (SNOWTEX 0, manufactured by Nissan Kagaku Kogyo KK)=1/2 (mass ratio) was dispersed in water, and was coated such that the mass thereof after drying was 0.2 g/m$^2$. This structure was used as the support.

Formation of Resin Layer (Undercoat Layer)

60 parts of a mixed solvent of water and methanol, whose methanol/water mass ratio was 35/65, was added to 40 parts of polyvinyl alcohol (PVA, degree of saponification: 30 to 40 mol %, degree of polymerization: 240, trade name: SMR 10-L, manufactured by Shin-Etsu Chemical Co., Ltd.), and the mixture was stirred and dissolved at 40° C. such that a PVA solution was prepared.

Next, 8 parts of water swellable synthetic mica (aspect ratio: 1000 or more, trade name: MEB-3, manufactured by Co-op Chemical Co., Ltd.) and 92 parts water were mixed together. Thereafter, wet dispersion was carried out by a viscomill, and a mica dispersed liquid having an average particle diameter of 2.0 $\mu$m was obtained. Water was added until the concentration of mica in the dispersed liquid was 5% by mass, and the solution was mixed uniformly so as to obtain the mica dispersed liquid.

173 parts methanol was added to 100 parts of the above PVA solution at 40° C., and sufficient stirring and mixing were carried out. Thereafter, 104 parts of the mica dispersed liquid (5% by mass) was added, and the mixture was sufficiently stirred and mixed. To this mixture was added 5 parts of an ethylene oxide surfactant (1.66%), and the liquid temperature was maintained at 35 to 40° C. Then, 0.2 parts of the following gelatin hardening agent E-1 was added, and a 6.1% coating solution (1) for resin layer was obtained. The proportion (mass ratio) of methanol contained in the coating solution (1) for resin layer was 60%.

General Formula (1)

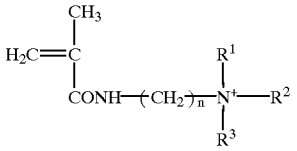

The coating solution (1) for resin layer was adjusted such that the coated amount of mica was 0.26 g/m$^2$, and was coated onto the front surface of the above support (the surface of the polyethylene film adhered to the base paper by the adhesive) by using a gravure roller (#65 mesh, diagonal lines), so as to form a resin layer serving as the undercoat layer. The WET coated amount at the time of coating was 21 g/m$^2$.

(Preparation of Recording Material)

Thereafter, in the same way as in Example 1, coating solutions for the recording layer and the like were prepared, and were coated onto the undercoat layer so as to form a recording material.

Example 8

A coating solution (2) for resin layer was prepared in the same way as in Example 7, except that the polyvinyl alcohol used in the preparation of coating solution (1) for resin layer in Example 7 was replaced with PVA-210 (degree of saponification 87-89 mol %, degree of polymerization: 1000, manufactured by Kuraray Co., Ltd.). At this time, the proportion (mass ratio) of methanol contained in the coating solution (2) for resin layer was 60%.

A recording material (2) of the present invention was prepared in the same way as in Example 7, except that the coating solution (2) for resin layer was used in place of the coating solution (1) for resin layer used in Example 7.

Examples 9 Through 11

A PVA solution was prepared in the same way as in Example 7, except that the polyvinyl alcohol used in the preparation of the coating solution (1) for resin layer of Example 7 was replaced with C-506 (degree of saponification: 74–80 mol %, degree of polymerization: 600, manufactured by Kuraray Co., Ltd.).

Coating solutions (3) through (5) for resin layer were prepared in the same manner as in Example 7, except that methanol was added to the above PVA solution in amounts such that the proportions (mass ratios) of methanol contained in the coating solutions for resin layer which were finally prepared were the proportions shown in following Table 3 (10, 60 and 80%).

Recording materials (3) through (5) of the present invention were prepared in the same way as in Example 7, except that the coating solutions (3) through (5) for resin layer were used in place of the coating solution (1) for resin layer used in Example 7.

Comparative Example 6

A coating solution (6) for resin layer was prepared in the same way as in Example 9, except that in the preparation of the coating solution (3) for resin layer of Example 9, the 60 parts of the mixed solvent used in the preparation of the PVA solution was replaced with 100 parts of water and no methanol was added to the PVA solution. At this time, the proportion of methanol contained in the coating solution (6) for resin layer was 0.

A recording material (6) of a Comparative Example was prepared in the same way as in Example 7, except that the coating solution (6) for resin layer was used in place of the coating solution (1) for resin layer used in Example 7.

Comparative Example 7

A coating solution (7) for resin layer was prepared in the same way as in Example 7, except that in the preparation of the coating solution (1) for resin layer of Example 7, the polyvinyl alcohol (SMR-10L) was replaced with PVA-117 (degree of saponification: 98–99 mol %, degree of polymerization: 1700, manufactured by Kuraray Co., Ltd.), the 60 parts of the mixed solvent used in the preparation of the PVA solution was replaced with 100 parts of water, and no methanol was added to the PVA solution. However, in the coating solution (7) for resin layer, coagulation occurred such that a uniform coating solution could not be obtained. At this time, the proportion of methanol contained in the coating solution (7) was 0.

A recording material (7) of a Comparative Example was prepared in the same way as in Example 7, except that the coating solution (7) for resin layer was used in place of the coating solution (1) for resin layer used in Example 7.

Comparative Example 8

Preparation of a coating solution for resin layer was carried out in the same way as in Example 9, except that the mass ratio of methanol/water in the mixed solvent of water and methanol in the preparation of the coating solution (3) for resin layer of Example 9 was changed to 65/35. However, in the preparation of the PVA solution, the PVA could not be completely dissolved in the aforementioned mixed solvent (having a mass ratio of 65/35), and a coating solution for resin layer could not be prepared.

Comparative Example 9

A coating solution (8) for resin layer was prepared in the same way as in Example 10, except that in the preparation of the coating solution (4) for resin layer of Example 10, the 60 parts of the mixed solvent used in the preparation of the PVA solution was replaced with 100 parts of water, and methanol was added to the PVA solution such that the proportion of methanol contained in the coating solution for resin layer was 60%.

A recording material (8) of a Comparative Example was prepared in the same way as in Example 7, except that the coating solution (8) for resin layer was used in place of the coating solution (1) for resin layer used in Example 7.

Comparative Example 10

Preparation of a coating solution for resin layer was carried out in the same way as in Example 7, except that in the preparation of the coating solution (1) for resin layer of Example 7, the polyvinyl alcohol (SMR-10L) was replaced with PVA-117 (degree of saponification: 98–99 mol %, degree of polymerization: 1700, manufactured by Kuraray Co., Ltd.). However, in the preparation of the PVA solution, the PVA could not be completely dissolved, and a coating solution for resin layer could not be prepared.

(Evaluation)

Measurement of Viscosity

In Examples 7 through 11 and Comparative Examples 6, 7 and 9, the viscosity at 40° C. of the prepared PVA solutions and the coating solutions (1) through (8) for resin layer, which contained the PVA solutions, were measured by using a B type viscometer.

The results of measurement are shown in following Table 3.

Evaluation of Resin Layer Surface

For the recording materials (1) through (8) obtained as described above, by using a digital color printer NC301D (manufactured by Fuji Photo Film Co., Ltd.), a cyan-colored solid image having a cyan density of 35% was outputted, the uniformity (the existence of image defects such as non-uniform color and the like) of the cyan density was evaluated visually in accordance with the following criteria, and was used to express the planarity (flatness) of the resin layer (undercoat layer). The results of evaluation are shown in following Table 3.

Evaluation Criteria

○ . . . Absolutely no non-uniformity of density in the image was observed, or non-uniform density was of an extent that was almost completely inconspicuous. Namely, the coating solution for resin layer was low viscosity, and a leveled flat surface was obtained.

× . . . Non-uniform coating of the surface of the resin layer (undercoat layer) was clearly expressed as non-uniform density in the cyan image. In other words, the coating solution for resin layer was high viscosity, leveling did not occur after coating such that non-uniform coating remained, and the flatness of the surface of the resin layer (undercoat layer) was poor.

The ratio of methanol contained in the coating solution for resin layer which was finally obtained was improved, and a coating solution for resin layer having a low viscosity which was excellent for leveling could be obtained. In recording materials (1) through (5) of the present invention formed by using these coating solutions for resin layer, the surface of the resin layer which was undercoated was flat, and images free of image defects such as non-uniform density could be formed.

As shown by Examples 9 through 11, a larger amount of alcohol contained in the coating solution was effective from the standpoint of achieving a lower viscosity.

In contrast, in Comparative Examples 6 and 9 in which mixed solvents were not used as the solvent in which the PVA was dissolved, a low viscosity PVA solution could not be prepared, and the viscosity of the coating solution for resin layer which was finally obtained could not be lowered to a viscosity at which leveling was possible. Accordingly, in recording materials (6) and (8) of comparative examples, a resin layer whose surface was flat could not be formed, and an image without non-uniform color could not be obtained. Further, as in the Comparative Example 8, even if a mixed solvent was used, the solubility decreased when the amount of methanol was too large. Moreover, in Comparative Example 7, which did not use a PVA having a degree of saponification and a degree of polymerization in ranges stipulated by the present invention, even the PVA solution had an extremely high viscosity, and a uniform coating solution could not be prepared.

TABLE 3

| | Polyvinyl alcohol (PVA) | | | Mixed solution: | PVA | Viscosity | Coating solution for resin layer | | | Evaluation of resin layer |
|---|---|---|---|---|---|---|---|---|---|---|
| | Type | Degree of saponification (mol %) | Degree of polymerization | mass ratio of methanol/water | solution: mass ratio of PVA/mica | (*1) of PVA solution [mPa · s] | Solution | Proportion of contained methanol (%) | Viscosity (*1) [mPa · s] | surface (evaluation of color non-uniformity) |
| Example 7 | SMR-10L (*2) | 30–40 | 240 | 35/65 | 1/0.26 | 18 | (1) | 60 | 9.0 | ○ |
| Example 8 | PVA-210 (*3) | 87–89 | 1000 | 35/65 | 1/0.26 | 380 | (2) | 60 | 24.8 | ○ |
| Example 9 | C-506 (*3) | 74–80 | 600 | 35/65 | 1/0.26 | 230 | (3) | 10 | 18.6 | ○ |
| Example 10 | C-506 (*3) | 74–80 | 600 | 35/65 | 1/0.26 | 230 | (4) | 60 | 13.5 | ○ |
| Example 11 | C-506 (*3) | 74–80 | 600 | 35/65 | 1/0.26 | 230 | (5) | 80 | 9.0 | ○ |
| Comp.Ex.6 | C-506 (*3) | 74–80 | 600 | 0/100 | 1/0.26 | 830 | (6) | 0 | 75.0 | X |
| Comp.Ex.7 | PVA-117 (*2) | 98–99 | 1700 | 0/100 | 1/0.26 | 4000 | (7) | 0 | coagulation | X |
| Comp.Ex.8 | C-506 (*3) | 74–80 | 600 | 65/35 | 1/0.26 | did not dissolve | | | | |
| Comp.Ex.9 | C-506 (*3) | 74–80 | 600 | 0/100 | 1/0.26 | 830 | (8) | 60 | 68.3 | X |
| Comp.Ex.10 | PVA-117 (*2) | 98–99 | 1700 | 35/65 | 1/0.26 | did not dissolve | | | | |

*1: Viscosity at 40° C., measured by B-type viscometer TV-20 (manufactured by Toki Sangyo KK)
*2: Manufactured by Shin-Etsu Chemical Co., Ltd.
*3: Manufactured by Kuraray Co., Ltd.

From the results of Table 3, it can be seen that in each of Examples 7 through 11, in which the PVA was a PVA having a degree of saponification and a degree of polymerization in the ranges stipulated in the present invention and which used a mixed solvent of water and an alcohol as the solvent in which the PVA was dissolved, a PVA solution obtained in an intermediate process could be prepared at a low viscosity.

The present invention provides a recording material having a resin layer which is formed by a coating solution which contains a high concentration of a water soluble resin such as PVA and which is of a low viscosity such that a flat surface can be formed by leveling. The resin layer has an excellent gas blocking property and flatness. Further, in the recording material of the present invention, image defects such as non-uniform color and the like do not arise.

What is claimed is:

1. A recording material comprising:

a support;

a recording layer capable of forming color due to application of at least one of heat and pressure thereto; and between the support and the recording layer, at least one resin layer containing polyvinyl alcohol, wherein the resin layer contains water swellable synthetic mica.

2. A recording material according to claim 1, wherein the degree of saponification of the polyvinyl alcohol is 30 mol % to 90 mol %.

3. A recording material according to claim 2, wherein the degree of polymerization of the polyvinyl alcohol is at most 1000.

4. A recording material according to claim 1, wherein the polyvinyl alcohol is a cationic polyvinyl alcohol.

5. A recording material according to claim 1, wherein the mass ratio of the polyvinyl alcohol to the water swellable synthetic mica is from 1.5 to 20.

6. A recording material according to claim 1, further comprising a protective layer.

7. A recording material according to claim 1, further comprising a light transmittance adjusting layer.

8. A recording material according to claim 1, wherein the recording layer is a layered structure type recording layer in which a plurality of single-color recording layers are layered.

9. A recording material according to claim 1 where the water swellable synthetic mica has a thickness of from 1 to 50 nm and has a surface size of from 1 to 20 $\mu$m.

10. A recording material according to claim 1 where the water swellable synthetic mica has an aspect ratio of 100 or more.

11. A recording material according to claim 1 where the water swellable synthetic mica is dispersed in a water based solvent with a water soluble resin-containing aqueous solution.

12. A recording material comprising:

a support;

a recording layer capable of forming color due to application of at least one of heat and pressure thereto; and between the support and the recording layer, a resin layer formed by coating a coating solution including polyvinyl alcohol dissolved in a mixed solvent comprising another alcohol and water, wherein solvent ratio of the another alcohol to the water is at most 1 by mass in the solvent, wherein the coating solution further includes water swellable synthetic mica.

13. A recording material according to claim 12, wherein the degree of saponification of the polyvinyl alcohol is 30 mol % to 90 mol %, and the degree of polymerization of the polyvinyl alcohol is at most 1000.

14. A recording material according to wherein the viscosity at 40° C. of the coating solution is from 5 to 100 mPa·s.

15. A recording material according to claim 14, wherein the viscosity at 40° C. of the coating solution is from 15 to 50 mPa·s.

16. A recording material according to claim 12, wherein the amount of polyvinyl alcohol in the coating solution is from 2 to 20% by mass with respect to total mass of the coating solution.

17. A recording material according to claim 12, wherein the another alcohol is methanol.

18. A recording material according to claim 12, wherein the solvent ratio of the another alcohol to the water is from 0.10 to 0.85.

19. A recording material comprising:

a support;

a resin layer including polyvinyl alcohol formed on the support; and a recording layer formed on the resin layer, wherein the resin layer is formed by a process including the steps of dissolving polyvinyl alcohol in a mixed solvent of water and alcohol to produce a polyvinyl alcohol solution, adding methanol to the polyvinyl alcohol solution to adjust viscosity thereof to a desired viscosity, adding a water swellable synthetic mica, coating the support with a layer of a solution, and drying the layer.

20. A recording material according to claim 19, wherein the desired viscosity is a viscosity at 40° C. of 5 to 100 mPa·s.

* * * * *